US011002517B1

(12) United States Patent
Holly

(10) Patent No.: US 11,002,517 B1
(45) Date of Patent: May 11, 2021

(54) FIREARM OPTICAL SIGHT ADAPTER

(71) Applicant: Michael Buchanan Holly, Richmond Hill, GA (US)

(72) Inventor: Michael Buchanan Holly, Richmond Hill, GA (US)

( * ) Notice: Subject to any disclaimer, the term of this patent is extended or adjusted under 35 U.S.C. 154(b) by 0 days.

(21) Appl. No.: 16/845,057

(22) Filed: Apr. 9, 2020

(51) Int. Cl.
*F41G 11/00* (2006.01)

(52) U.S. Cl.
CPC ..... *F41G 11/002* (2013.01)

(58) Field of Classification Search
CPC ..... F41G 1/16; F41G 1/26; F41G 11/002
See application file for complete search history.

(56) References Cited

U.S. PATENT DOCUMENTS

| | | | |
|---|---|---|---|
| 6,327,806 | B1 | 12/2001 | Paige |
| 7,946,074 | B2 | 5/2011 | Nemec |
| 8,082,688 | B2 | 12/2011 | Elpedes |
| 8,832,983 | B1 | 9/2014 | Wolf |
| 9,046,320 | B2 | 6/2015 | Keng |
| 9,062,936 | B2 | 6/2015 | Zimmer |
| 9,354,022 | B2 | 5/2016 | Eriksson |
| 9,410,770 | B2 | 8/2016 | Zimmer |
| 9,506,726 | B2 | 11/2016 | Wolf |
| 9,574,853 | B2 | 2/2017 | Crispin |
| 9,696,114 | B1 | 7/2017 | Cabrera |
| 9,863,740 | B2 | 1/2018 | Wolf |
| 10,024,628 | B2 | 1/2018 | Toner |
| 10,036,613 | B2 | 7/2018 | Huff |
| 10,352,654 | B2 | 7/2019 | Costet |
| D868,923 | S | 12/2019 | Toner |
| 10,563,955 | B2 | 2/2020 | Pniel |
| 2005/0057808 | A1 | 3/2005 | Houde-Walter |
| 2007/0234625 | A1 | 10/2007 | Kidd |
| 2008/0062487 | A1 | 3/2008 | Houde-Walter |
| 2013/0219767 | A1 | 8/2013 | Peterson |

(Continued)

FOREIGN PATENT DOCUMENTS

| | | |
|---|---|---|
| CN | 207751390 U | 8/2018 |
| CN | 210089500 U | 2/2020 |

(Continued)

OTHER PUBLICATIONS

Instagram screen images, published Feb. 1, 2019 and Mar. 20, 2019, obtained Jun. 29, 2020.

*Primary Examiner* — Reginald S Tillman, Jr.
(74) *Attorney, Agent, or Firm* — Kevin M. Able

(57) ABSTRACT

A firearm optical sight adapter is disclosed. The optical sight adapter can include an adapter plate with first and second opposing mounting surfaces, and a registration pin integral with the mounting plate and extending orthogonally from the first mounting surface. The optical sight adapter may further include a socket having a recess extending from the second mounting surface to a bottom wall intermediate between the first and mounting surfaces and an aperture extending from the bottom wall of the recess through the first mounting surface along a first longitudinal axis, and wherein a periphery of the recess is not circularly symmetric relative to the first longitudinal axis. The optical sight adapter may still further include a recoil buffer extending upright from the first surface a distance at least 0.3 times a length of the adapter plate, the recoil buffer defining an opening therethrough.

22 Claims, 17 Drawing Sheets

(56) References Cited

U.S. PATENT DOCUMENTS

| | | | | |
|---|---|---|---|---|
| 2013/0283660 | A1 | 10/2013 | Matthews | |
| 2014/0109456 | A1 | 4/2014 | Jung | |
| 2014/0150325 | A1 | 6/2014 | Keng | |
| 2014/0230305 | A1 | 8/2014 | Zimmer | |
| 2015/0268002 | A1* | 9/2015 | Jeung | F41G 11/003 42/71.02 |
| 2015/0276350 | A1 | 10/2015 | Zimmer | |
| 2016/0102943 | A1 | 4/2016 | Teetzel | |
| 2016/0334193 | A1 | 11/2016 | Zimmer | |
| 2017/0059277 | A1 | 3/2017 | Justice | |
| 2018/0195835 | A1 | 7/2018 | Crispin | |
| 2019/0049217 | A1 | 2/2019 | Costet | |
| 2019/0257620 | A1 | 8/2019 | Zimmer | |
| 2019/0331461 | A1 | 10/2019 | Zimmer | |
| 2020/0025520 | A1 | 1/2020 | Niswander | |

FOREIGN PATENT DOCUMENTS

| | | | | |
|---|---|---|---|---|
| EP | 2982927 | A1 | 2/2016 | |
| FR | 2611036 | B3 * | 6/1989 | F41G 11/002 |
| WO | 2013003873 | A1 | 1/2013 | |

* cited by examiner

FIREARM OPTICAL SIGHT ADAPTER

FIELD

The present disclosure is directed to an adapter configured to mate an optical sight to a firearm, and more particularly to a handgun, such as a semi-automatic handgun comprising a reciprocating slide.

BACKGROUND

It is known to mount electronic sights to a firearm. As used herein, an electronic sight is a firearm sight using an electrically-powered light source to project an aiming indicium onto an optical element serving as a viewing screen to the shooter. Such sights may also be referred to as e.g., reflective ("reflex") sights or red-dot sights. Electronic sights can provide fast target acquisition, are theoretically parallax-free, useable in adverse environments such as low-light conditions and can overcome the limitations of aging eyesight. The advent of small, rugged electronic sights have allowed electronic sights to be mounted on a variety of firearms, and in particular, mounted on the slide of a semi-automatic handgun, wherein such sighting devices are capable of surviving the harsh recoil imparted to the sight associated with the reciprocating slide during firing.

In many instances, the handgun slide can be modified, for example by using common machining methods to mill a recess into the slide, the recess configured to accept an electronic sight with a predetermined footprint. Slide modification can be undertaken by the firearm manufacturer or by a competent gunsmith post-manufacture. However, such modifications are permanent, and using a different electronic sight with a different footprint may require further modification of the slide, which may not be possible. Moreover, given the large assortment of slide designs from an expansive number of firearm manufacturers, it would be impractical for electronic sight manufacturers to modify electronic sight designs to accommodate the many firearm configurations. Similarly, it would be prohibitive for firearm manufacturers to produce a different version firearm for each available electronic sight design. Accordingly, an interface device mounted between the handgun slide and the electronic sight can provide an inexpensive bridge between a particular handgun and a given electronic sight. A change to the electronic sight, for example switching to an electronic sight from a different manufacturer with a different footprint, can be accomplished with a simple change of the interface device, thereby allowing a larger assortment of electronic sights that can used with a given firearm than if an interface device was not used.

Traditional sight adapters for handguns are typically flat plates secured to the handgun by threaded fasteners. Once the adapter plate is secured to the handgun, an electronic sight can then be secured to the adapter plate by inserting additional threaded fasteners through passages in the electronic sight body and engaging the threaded fasteners in threaded apertures extending through a thickness of the adapter plate only. Unfortunately, because such adapter plates are typically thin, a limited number of threads are available to engage with these additional fasteners, limiting the robustness of the coupling and providing a potential failure point.

SUMMARY

A firearm optical sight adapter is disclosed, comprising an adapter plate including a first mounting surface and a second mounting surface opposite the first mounting surface, a registration pin integral with the mounting plate and extending orthogonally from the first mounting surface, and a socket comprising a recess extending from the second mounting surface to a bottom wall located intermediate between the first mounting surface and the second mounting surface and an aperture extending from the bottom wall of the recess through the first mounting surface along a first longitudinal axis, and wherein a periphery of the recess is not circularly symmetric relative to the first longitudinal axis. That is, for a line segment extending from the first longitudinal axis to the periphery of the recess, as the line segment is rotated about the first longitudinal axis, a length of the line segment varies.

The firearm optical sight adapter may further comprise a mounting post removably engaged in the socket, the mounting post comprising a flange and a shaft extending from the flange through the first aperture, the shaft terminating a distance R beyond the first mounting surface, the mounting post further defining a threaded passage extending along a second longitudinal axis coaxial with the first longitudinal axis. R can be equal to or greater than about 1 millimeter (mm), for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. In various embodiments, a shape of the flange can be complementary to a shape of the recess, and wherein the recess and the flange can be configured to resist rotation of the mounting post about the first longitudinal axis when a torque is applied to the mounting post.

The adapter plate further comprises a first end and a second end opposite the first end, and a recoil buffer integral with the mounting plate and disposed at the first end of the mounting plate, the recoil buffer extending upright from the first surface. In some embodiments, the recoil buffer can comprise an arcuate surface facing the second end. For example, the arcuate surface can comprise a first curvature in a first direction. In some embodiments, the arcuate surface can comprise a second curvature orthogonal to the first curvature.

In various embodiments, the first end and the second end define a length of the adapter plate therebetween, and a height of the recoil buffer relative to the first mounting surface can be at least 0.25 times the length of the adapter plate, for example at least about 0.3 times the length of the adapter plate. The recoil buffer can define an opening positioned between a first side member and a second side member, a cross-member extending above the opening between a top of the first side member and a top of the second side member.

In some embodiments, the adapter plate may further comprise a side edge surface between the first end and the second end, the side edge comprising a chamfer intersecting the second mounting surface.

In still other embodiments, a firearm optical sight adapter is described, comprising an adapter plate comprising a first mounting surface, a second mounting surface opposite the first mounting surface, and a first end and a second end opposite the first end, the first end and the second end defining a length therebetween. The adapter plate may further comprise a registration pin integral with the adapter plate and extending orthogonally from the first mounting surface and a recoil buffer integral with the mounting plate disposed at the first end of the mounting plate, the recoil buffer extending upright from the first mounting surface and comprising a height above the first mounting surface greater than about 0.25 times the length of the adapter plate, the recoil buffer comprising a frame defining an opening therethrough.

The adapter plate may still further comprise a socket comprising a recess extending from the second mounting surface to a bottom wall located intermediate between the first mounting surface and the second mounting surface and an aperture extending along a first longitudinal axis from the bottom wall of the recess through the first mounting surface. In some embodiments, a periphery of the recess is not circularly symmetric relative to the first longitudinal axis. That is, for a line segment extending from and orthogonal to the first longitudinal axis and terminating at the periphery of the recess, as the line segment is rotated about the first longitudinal axis, a length of the line segment varies.

In various embodiments, the firearm optical sight adapter may further comprise a mounting post removably engaged in the socket, the mounting post comprising a flange and a shaft extending from the flange through the second aperture, the shaft terminating at least about 1 mm beyond the first mounting surface. The mounting post may define a threaded passage extending along a second longitudinal axis, the second longitudinal axis coaxial with the first longitudinal axis. A shape of the flange can be complementary to a shape of the recess, wherein the recess and the flange are configured to resist rotation of the mounting post about the longitudinal axis of the shaft when a torque is applied to the mounting post. In various embodiments, a periphery of the flange is not circularly symmetric with the first longitudinal axis. That is, for a line segment extending from and orthogonal to the first longitudinal axis and terminating at the periphery of the flange, as the line segment is rotated about the first longitudinal axis, a length of the line segment varies.

In some embodiments, the recoil buffer can comprise an arcuate surface facing in a direction toward the second end, the arcuate surface comprising a first curvature in a first direction. In some embodiments, the arcuate surface may further comprise a second curvature orthogonal to the first curvature.

In some embodiments, the opening can be bounded by a frame comprising a first side member, a second side member opposite the first side member, and a cross-member extending from a top of the first side member to a top of the second side member, a bottom surface of the cross member comprising an upwardly convex curvature that defines a top of the opening.

The firearm optical sight adapter may further comprise a recess in the front end of the adapter plate, the recess intersecting the second mounting surface.

In yet other embodiments, a firearm optical sight adapter is disclosed, comprising an adapter plate comprising a first mounting surface, a second mounting surface opposite the first mounting surface, a first end and a second end opposite the first end, the first end and the second end defining a length therebetween, and a registration pin integral with the adapter plate and extending orthogonally from the first mounting surface. The adapter plate may further comprise a recoil buffer integral with the mounting plate disposed at the first end of the mounting plate, the recoil buffer extending upright from the first mounting surface a distance of at least 0.25 times the length of the adapter plate and comprising a D-shaped opening therein.

The adapter plate may include a socket comprising a recess extending from the second mounting surface to a bottom wall located intermediate between the first mounting surface and the second mounting surface and an aperture extending along a first longitudinal axis from the bottom wall of the recess through the first mounting surface. In various embodiments, the recess is not circularly symmetric relative to the first longitudinal axis. That is, for a line segment extending from and orthogonal to the first longitudinal axis and terminating at the periphery of the recess, as the line segment is rotated about the first longitudinal axis, a length of the line segment varies.

The firearm optical sight adapter may further comprise a mounting post removably engaged in the socket, the mounting post comprising a flange and a shaft extending from the flange through the second aperture, the shaft terminating at least about 1 mm beyond the first mounting surface, the mounting post further defining a threaded passage extending along a second longitudinal axis, the second longitudinal axis coaxial with the first longitudinal axis.

In various embodiments, a shape of the flange can be complementary to a shape of the recess, and wherein the recess and the flange are configured to resist rotation of the mounting post about the first longitudinal axis when a torque is applied to the mounting post.

In some embodiments, the adapter plate may further comprise a recess extending across a width of the adapter plate defined between a first side edge surface and a second side edge surface, the recess positioned below the D-shaped opening and intersecting the second mounting surface.

The adapter plate may further comprise a registration pin integral with the adapter plate and extending orthogonally from the first mounting surface.

In still other embodiments, a firearm is disclosed, the firearm comprising a frame and a slide slidingly engaged with the frame, the slide comprising a recessed area. An optical sight adapter can be positioned in the recessed area and coupled to the slide, the optical sight adapter comprising an adapter plate with a first mounting surface, a second mounting surface opposite the first mounting surface, and a first end and a second end opposite the first end, the first end and the second end defining a length therebetween. The adapter plate may further comprise a registration pin integral with the adapter plate and extending orthogonally from the first mounting surface and a recoil buffer integral with the mounting plate disposed at the first end of the mounting plate, the recoil buffer extending upright from the first mounting surface and comprising a height above the first mounting surface greater than about 0.25 times the length of the adapter plate, for example at least about 0.30 times the length of the adapter plate, such as at least about 0.45 times the length of the adapter plate, the recoil buffer comprising a frame defining an opening therethrough.

The adapter plate may still further comprise a socket comprising a recess extending from the second mounting surface to a bottom wall located intermediate between the first mounting surface and the second mounting surface and an aperture extending along a first longitudinal axis from the bottom wall of the recess through the first mounting surface. In some embodiments, a periphery of the recess is circularly asymmetric relative to the first longitudinal axis. That is, for a line segment extending from and orthogonal to the first longitudinal axis and terminating at the periphery of the recess, as the line segment is rotated about the first longitudinal axis, a length of the line segment varies.

In various embodiments, the firearm optical sight adapter may further comprise a mounting post removably engaged in the socket, the mounting post comprising a flange and a shaft extending from the flange through the second aperture, the shaft terminating at least about 1 mm beyond the first mounting surface. The mounting post may define a threaded passage extending along a second longitudinal axis, the second longitudinal axis coaxial with the first longitudinal axis. A shape of the flange can be complementary to a shape of the recess, wherein the recess and the flange are configured to resist rotation of the mounting post about the longitudinal axis of the shaft when a torque is applied to the mounting post. In various embodiments, a periphery of the flange is not circularly symmetric with the first longitudinal axis. That is, for a line segment extending from and orthogonal to the first longitudinal axis and terminating at the periphery of the flange, as the line segment is rotated about the first longitudinal axis, a length of the line segment varies.

In some embodiments, the recoil buffer can comprise an arcuate surface facing in a direction toward the second end, the arcuate surface comprising a first curvature in a first direction. In some embodiments, the arcuate surface may further comprise a second curvature orthogonal to the first curvature.

In some embodiments, the opening can be bounded by a frame comprising a first side member, a second side member opposite the first side member, and a cross-member extending from a top of the first side member to a top of the second side member, a bottom surface of the cross member comprising an upwardly convex curvature that defines a top of the opening.

The firearm optical sight adapter may further comprise a recess in the front end of the adapter plate, the recess intersecting the second mounting surface.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

DETAILED DESCRIPTION

Figure 1:
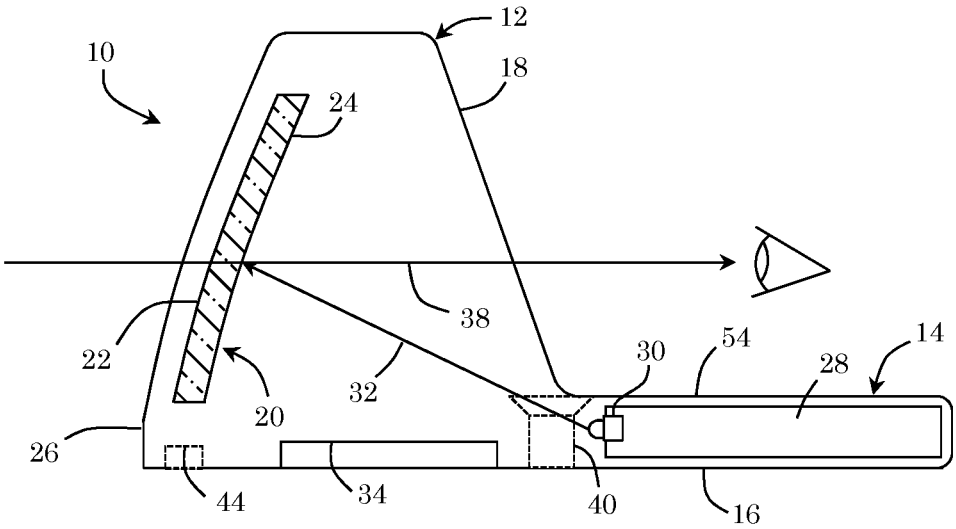
FIG. 1 is a schematic drawing of an exemplary optical sight showing a principal of operation.

Reference will now be made in detail to embodiments of the present disclosure, examples of which are illustrated in the accompanying drawings. Whenever possible, the same reference numerals will be used throughout the drawings to refer to the same or like parts. However, this disclosure can be embodied in many different forms and should not be construed as limited to the embodiments set forth herein.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Ranges can be expressed herein as from "about" one particular value, and/or to "about" another particular value. When such a range is expressed, another embodiment includes from the one particular value to the other particular value. Similarly, when values are expressed as approximations by use of the antecedent "about," it will be understood that the particular value forms another embodiment. It will be further understood that the endpoints of each of the ranges are significant both in relation to the other endpoint, and independently of the other endpoint.

Directional terms as used herein—for example, up, down, right, left, front, back, top, bottom—are made only with reference to the figures as drawn and are not intended to imply absolute orientation.

Unless otherwise expressly stated, it is in no way intended that any method set forth herein be construed as requiring that its steps be performed in a specific order, nor that with any apparatus, specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

As used herein, the singular forms "a," "an," and "the" include plural references unless the context clearly dictates otherwise. Thus, for example, reference to "a" component includes aspects having two or more such components, unless the context clearly indicates otherwise.

The word "exemplary," "example," or various forms thereof are used herein to mean serving as an example, instance, or illustration. Any aspect or design described herein as "exemplary" or as an "example" should not be construed as preferred or advantageous over other aspects or designs. Furthermore, examples are provided solely for purposes of clarity and understanding and are not meant to limit or restrict the disclosed subject matter or relevant portions of this disclosure in any manner. It can be appreciated that a myriad of additional or alternate examples of varying scope could have been presented but have been omitted for purposes of brevity.

As used herein, the terms "comprising" and "including," and variations thereof, shall be construed as synonymous and open-ended, unless otherwise indicated. A list of elements following the transitional phrases comprising or including is a non-exclusive list, such that elements in addition to those specifically recited in the list may also be present.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein, complementary shapes are shapes with opposing boundaries that fit intimately together, such as by abutment. Examples of complementary shapes: assembled puzzle pieces have complementary edges, and; a three-dimensional mold and a part formed therewith have complementary surfaces.

Figure 2:
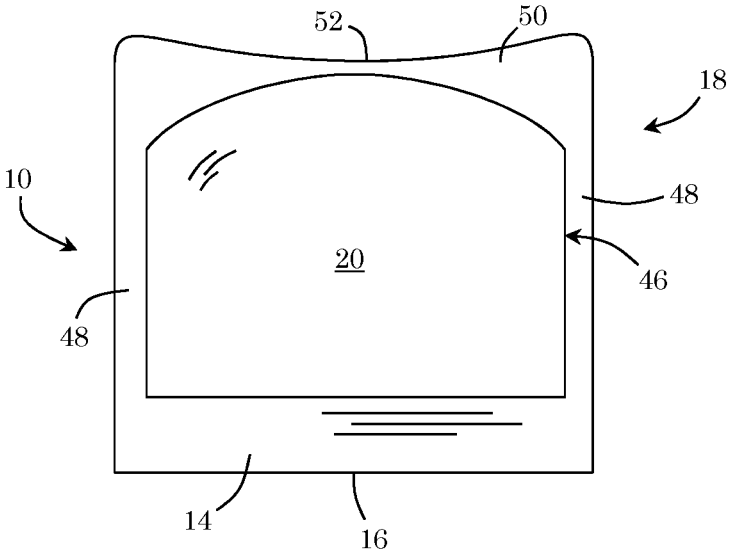
FIG. 2 is a front view of the optical sight of FIG. 1.
Figure 3:
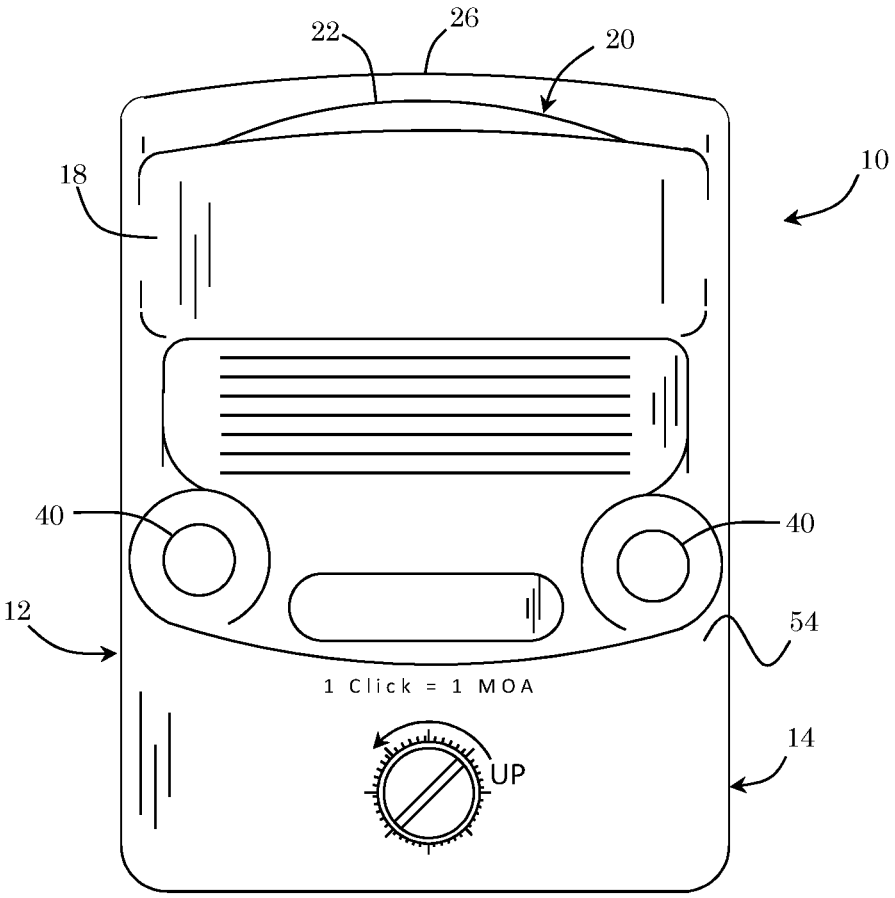
FIG. 3 is a top view of the optical sight of FIGS. 1 and 2.

FIGS. 1-3 depict an exemplary electronic sight (hereinafter "optical sight") 10 comprising housing 12 including base 14 having a bottom mounting surface 16 and a canopy 18 positioned forward on base 14 (optical sight 10 is shown transparent so that internal components can be viewed). Canopy 18 can be integral with base 14. As used herein, integral means individual portions are formed together as a single, monolithic part. For example, in some embodiments, housing 12, including base 14 and canopy 18, can be formed of a polymer (plastic) material, such as a polycarbonate or acrylonitrile butadiene styrene (ABS), for example by injection molding or 3D printing. However, in further embodiments, housing 12 can be machined or cast metal, for example machined or cast aluminum or aluminum alloy. Optical sight 10 further comprises optical element 20 comprising a front surface 22 arranged to face the target and a rear surface 24 arranged to face the shooter. Optical element 20 can be mounted in a generally upright orientation in canopy 18 proximate forward end 26 of housing 12. Optical element 20 can comprise a glass or plastic optical element, or a combination thereof. For example, optical element 20 can comprise a laminated structure and in various embodiments, optical element 20 may be coated with one or more coatings such as vapor-deposited anti-reflection coatings and the like. One or both front and rear surfaces 22, 24 can be aspherical surfaces. Optical element 20 can be fitted into canopy 18 by inserting optical element 20 into a locating groove extending around an inner wall of canopy 18, thereby locating optical element 20 in a predetermined orientation within canopy 18, and securing optical element 20 therein, for example, by an adhesive. Other methods of mounting optical element 20 in canopy 18 as known in the art may be used.

Base 14 may further comprise an electronics module 28 including circuitry needed to operate light source 30 arranged to direct a beam of light 32 at rear surface 24 and create an illuminated indicium (e., a dot, a circle, a cross, and the like) superimposed on a target image for the shooter to align the handgun with the target (not shown) as viewed through optical element 20. Base 14 may further include a battery compartment 34 to house a battery to power the circuitry and light source 30. Light source 30, e.g., a light emitting diode (LED), can be aligned with the center of the optical axis of surfaces 22, 24 but lie below line of sight 38. The optical axis may also be parallel to line of sight 38. Thus, light source 30 provides an illuminated indicium which can be viewed superimposed on an undisturbed image of the target. This avoids the need to angle the optical axis relative to line of sight 38 to avoid the light source and housing entering and/or masking the viewed image area and resulting in a disturbed image of the target. Base 14 also comprises a through-passage 40 configured to receive threaded fastener 42 and arranged such that threaded fastener 42 can engage with a mounting surface of a firearm or an adapter. Through-passage 40 may not be threaded. Additionally, base 14 may further comprise recess 44, for example two or more recesses 44, configured to receive an adapter plate registration feature, e.g., a registration pin or pins. While the following description is presented in the context of a handgun, optical sight 10 may be mounted to a variety of firearms using the optical sight adapter disclosed herein, or variations thereof.

FIG. 2 is a front view of optical sight 10 showing canopy 18 defining an opening 46 (e.g., window), wherein optical element 20 extends across the opening. Opening 46 is bounded by side members 48 extending upwardly from base 14, an upper cross-member 50 extending between side members 48, and a base 14 opposite cross-member 50. In some embodiments, opening 46 may have a D-shape comprising linear bottom and sides, and an upwardly convex top, although in further embodiments, opening 46 may have other shapes, for example a round or oval, or elliptical shape. An upper surface 52 of cross-member 50 may have a downwardly concave curvature. As such, side members 48 may extend a greater distance above base 14 than cross-member 50, and an impact with the top of optical sight 10 may thereby be transmitted to body 14 rather than optical element 20. However, in further embodiments, upper surface 52 may have an upwardly convex curvature. FIG. 3 is a top view of optical sight 10 and depicts a pair of through-passages 40 extending from a top surface 54 of base 14 to bottom mounting surface 16 for mounting optical sight 10 to a firearm.

Figure 4:
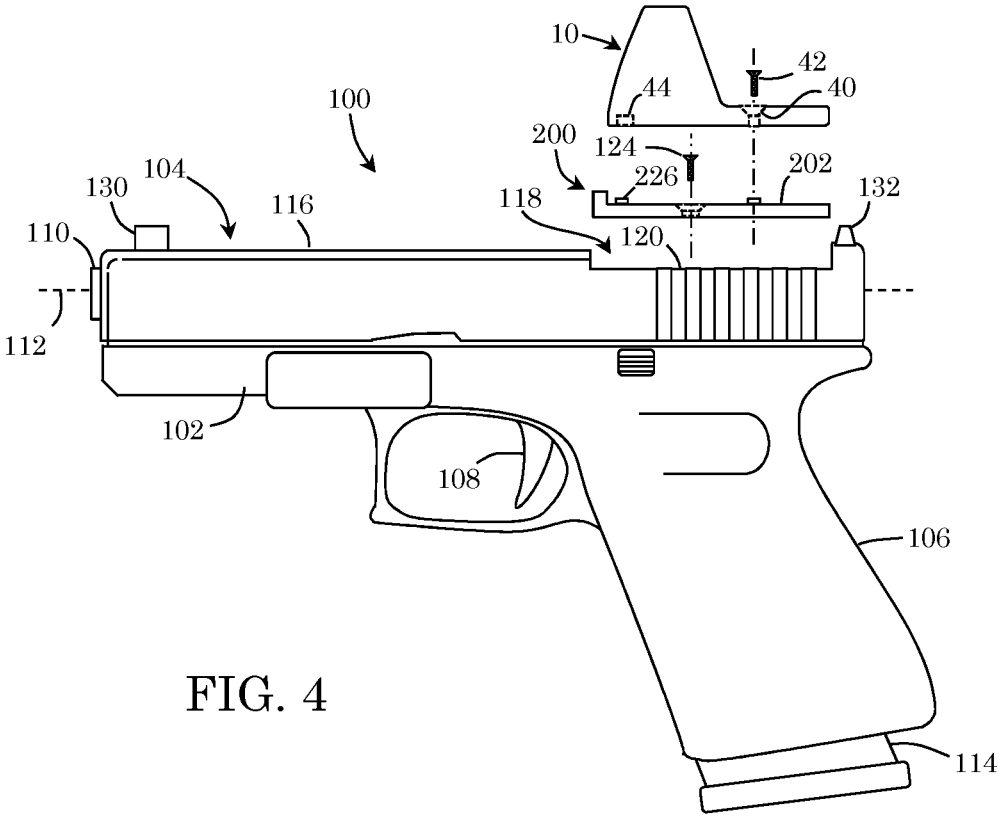
FIG. 4 is a side, partially exploded, schematic view of an exemplary handgun including an optical sight adapter and an optical sight mounted to the handgun slide with the optical sight adapter.
Figure 5:
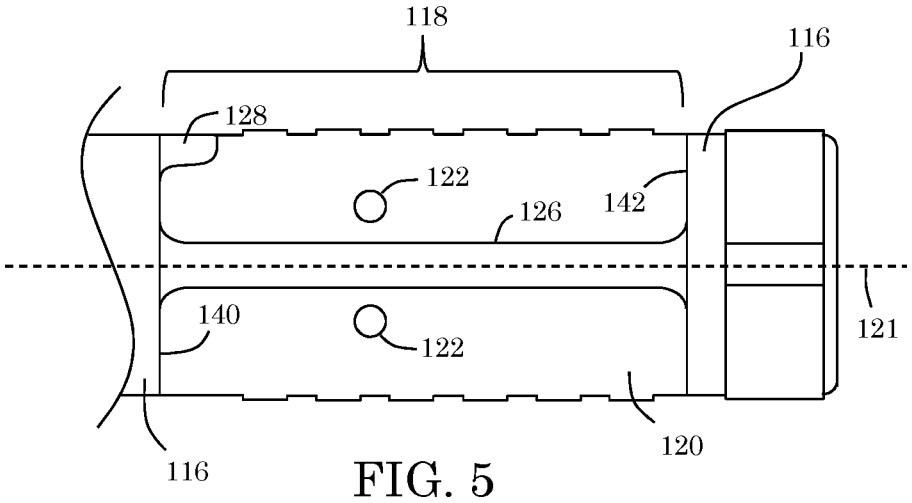
FIG. 5 is a top view of a recessed area of the handgun slide configured to receive an optical sight adapter.
Figure 6:
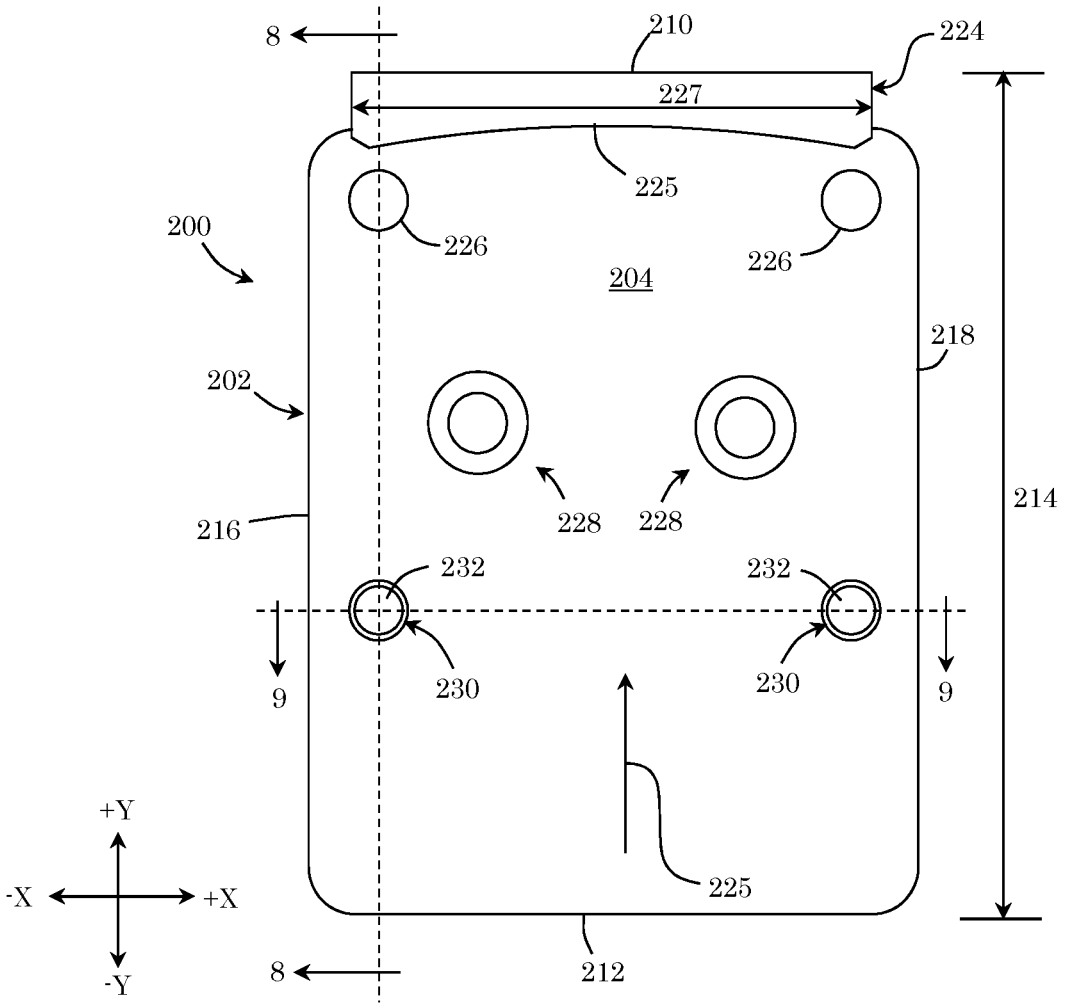
FIG. 6 is a schematic view of an exemplary optical sight adapter according to an embodiment of the present disclosure and showing an upper mounting surface.
Figure 7:
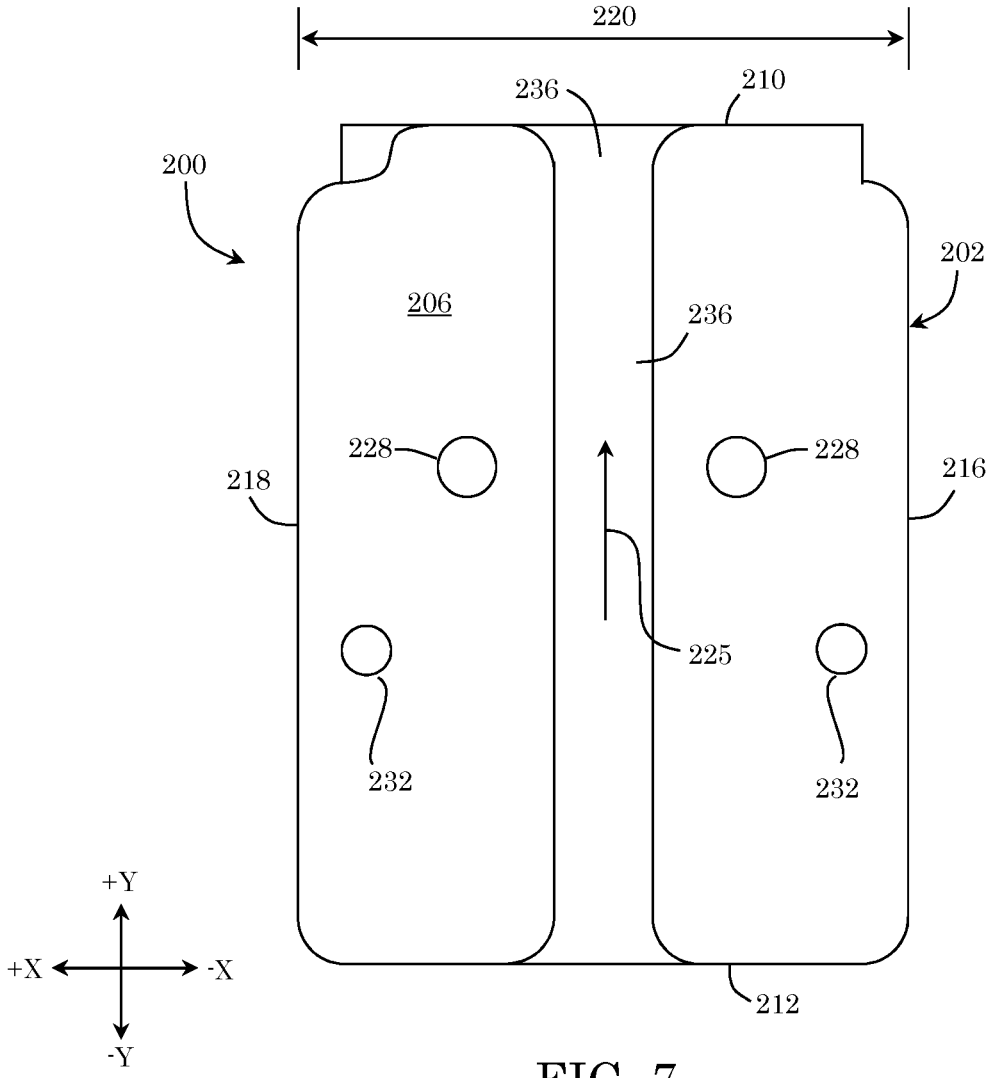
FIG. 7 is a schematic view of the lower mounting surface of the optical sight adapter of FIG. 6.

Turning now to FIGS. 4 and 5, a partially exploded view of an exemplary handgun 100 is shown, handgun 100 comprising a frame 102, a slide 104 slidingly engaged with frame 102, a grip 106, a trigger 108 housed by frame 102 and operatively connected to a trigger assembly (not shown), a barrel 110 comprising longitudinal axis 112, a barrel 110 housed in a channel in slide 104, and a magazine 114 housed in grip 106 and configured to hold ammunition biased by a spring that urges ammunition cartridges toward a feed end of the magazine. Slide 104 comprises an upper surface 116 including a recessed area 118. Recessed area 118 may be machined into upper surface 116, such as by milling. A top view of recessed area 118 is provided in FIG. 5 showing a bottom surface 120 of recessed area 118 defining threaded passages 122 configured to receive and engage with threaded fasteners 124 (see FIG. 4). In some embodiments, bottom surface 120 may include an orientation feature 126 configured to orient, for example, align, a mounted article such as an optical sight or optical sight adapter plate, and prevent lateral movement of the article. In the illustrated embodiment, orientation feature 126 can comprise a raised ridge of slide material machined proud of bottom surface 120 and extending longitudinally along a length direction, e.g., along axis 121 (e.g., parallel with longitudinal axis 112 of barrel 110) of the recessed area and extending upward from bottom surface 120. However, the particular size, shape and orientation of any one or more orientation features can vary depending on handgun manufacturer and handgun design, and the illustration of FIG. 5 is not limiting in this regard. For example, orientation features may take the form of posts, pins, indents, recesses, or the like. In the embodiment depicted in FIG. 2, bottom surface 120 is shown comprising an additional raised orientation feature 128.

In various embodiments, handgun 100 may further comprise iron sights including front sight 130 and rear sight 132. Front sight 130 may be a blade, a ball, a rod, or any other suitable aiming device. Rear sight 132 may comprise a notch, such as a V-shaped notch, a U-shaped notch, a peep hole, or the like, through which front sight 130 is viewed and aligned by the shooter. In accordance with embodiments described herein, optical sight 10 can be mounted to slide 104 via optical sight adapter 200 coupled to bottom surface 120 of recessed area 118 and extending between forward surface 140 and rear surface 142 of recessed area 118 and described in greater detail herein below. In some embodiments, optical sight 10 can be arranged such that the iron sights can be co-witnessed through optical sight 10 thereby allowing the shooter to continue aiming if the optical sight fails.

Figure 8:
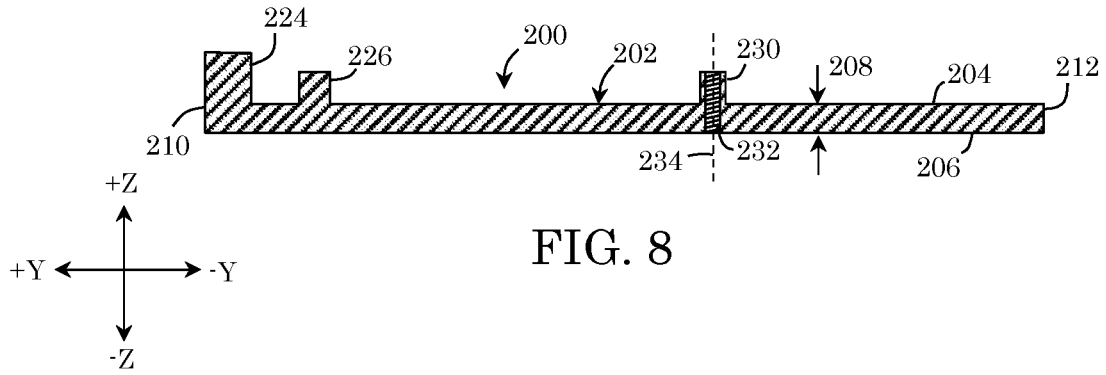
FIG. 8 is a cross-sectional view of the optical sight adapter of FIG. 6 taken along line 8-8 illustrating internally-threaded integral mounting posts.

As seen in FIGS. 6-10, optical sight adapter 200 according to some embodiments can comprise a generally rectangular adapter plate 202 comprising a first (upper) mounting surface 204 (FIG. 6), a second (lower) mounting surface 206 (FIG. 7), and a thickness 208 defined between first mounting surface 204 and second mounting surface 206 along a normal to at least one of the first or second mounting surfaces (FIG. 8). In various embodiments, first mounting surface 204 and second mounting surface 206 can be parallel to each other. In various embodiments, first mounting surface 204 and second mounting surface 206 can be generally planar. In some embodiments optical sight adapter 200 can be formed of a polymer (plastic) material, for example by injection molding or 3D printing. However, in further embodiments, optical sight adapter 200 can be metal, for example machined, cast, or 3D-printed metal, such as but not limited to aluminum or an aluminum alloy.

Optical sight adapter 200 further comprises a forward end 210 and a rear end 212 defining a length 214 therebetween, and a first side edge surface 216 and a second side edge surface 218 defining a width 220 therebetween orthogonal to length 214. Length 214 and width 220 will depend on the design of slide 104 and more particularly the length and width of recessed area 118 and the length and width of optical sight 10. However, by way of example and not limitation, in some embodiments, length 214 can be in a range from about 4 cm to about 6 cm, for example in a range from about 4.2 cm to about 5.5 cm, such as in a range from about 4.5 cm to about 5.2 cm, including all ranges and subranges therebetween, and width 220 can be in a range from about 2.5 cm to about 3 cm, for example in a range from about 2.6 cm to about 2.8 cm, including all ranges and subranges therebetween, although other dimensions as warranted by the handgun design are contemplated. First and second side edge surfaces 216, 218 can, in various embodiments, be flat surfaces and extend parallel to one another. However, in further embodiments, side surfaces 216, 218 may include channels, raised areas, or other gripping features used to manipulate slide 104. Such gripping features may correspond to similar gripping features located on slide 104. A proper grip on handgun 100 by a shooter, for example a two-handed grip, may place the shooter's thumbs alongside the slide, wherein sharp edges on adapter plate 202 may cause injury to the shooter as the slide reciprocates during discharge of the handgun. Accordingly, in some embodiments, at least one of first side edge surface 216 or second side edge surface 218 may comprise a chamfer 222 (see FIG. 9). In some embodiments, chamfer 222 may connect with second mounting surface 206 but not first mounting surface 204. That is, only a portion of first side edge 216 and/or second side edge 218 may be chamfered, such as a bottom portion of each side edge. In addition, chamfer 222 can provide a transition from a width of slide recessed area 118 to a width of optical sight 10. That is, in some embodiments, a width of optical sight 10 (in a direction orthogonal to longitudinal axis 112) may be greater than width 220 of recessed area 118. Thus, chamfer 222 can provide both a functional and an aesthetic transition from the width of recessed area 118 to the width of optical sight 10.

Optical sight adapter 200 may further comprise an integral recoil buffer 224 positioned at forward end 210 and extending upright (in the +Z direction, see FIG. 8) from first mounting surface 204. For example, in some embodiments, recoil buffer 224 may extend orthogonally from first mounting surface 204. Recoil buffer 224 can provide forward support to optical sight 10 during recoil of slide 104. The term "forward", when used in connection with any of the optical sight adapters disclosed herein, refers to a direction from rear end 212 toward forward end 210, e.g., along arrow 225, or positioned closer to forward end 210 than rear end 212. In embodiments, rear-facing support surface 225 may have a shape complementary to forward end 26 of optical sight 10 so that when optical sight 10 is mounted on optical sight adapter 200, contact between forward end 26 of optical sight 10 and support surface 225 can be maximized. A width 227 of recoil buffer 224 can be at least 0.5 times width 220, for example at least about 0.75 times width 220. In some embodiments, width 227 of recoil buffer 224 can be equal to width 220.

First mounting surface 204 can be configured to engage with bottom mounting surface 16 of optical sight 10, while second mounting surface 206 is configured to engage with bottom surface 120 of recessed area 118. Accordingly, optical sight adapter 200, and in particular, adapter plate 202, can function as a mating interface between slide 104 and optical sight 10. In various embodiments, thickness 208 of adapter plate 202 can be in a range from about 2 mm to about 4 mm, for example in a range from about 2.0 mm to about 3.5 mm, such as in a range from about 2.0 mm to about 3.0 mm, in a range from about 2.0 mm to about 2.5 mm, in a range from about 2.0 mm to about 2.4 mm, in a range from about 2.0 mm to about 2.2 mm, in a range from about 2.3 mm to about 4.0 mm, in a range from about 2.5 mm to about 4.0 mm, in a range from about 2.7 to about 4.0 mm, or in a range from about 3.0 mm to about 4.0 mm, including all ranges and subranges therebetween.

First mounting surface 204 may further comprise one or more registration pins 226 extending upward (in the +Z direction), for example orthogonally, from first mounting surface 204. Registration pins 226 may, for example, be located at the forward half of adapter plate 202, such as proximate recoil buffer 224. Additionally, adapter plate 202 may include one or more apertures 228 for mounting optical sight adapter 200 to bottom surface 120 of recessed area 118 via threaded fasteners 124. Apertures 228 may comprise a chamfered upper surface connecting to first mounting surface 204. That is, the one or more apertures 228 can be countersunk to receive a fastener head, e.g., screw head. Threaded fasteners 124 can be inserted through apertures 228 and engaged with threaded passages 122, thereby coupling optical sight adapter 200 to handgun 100.

Figure 9:
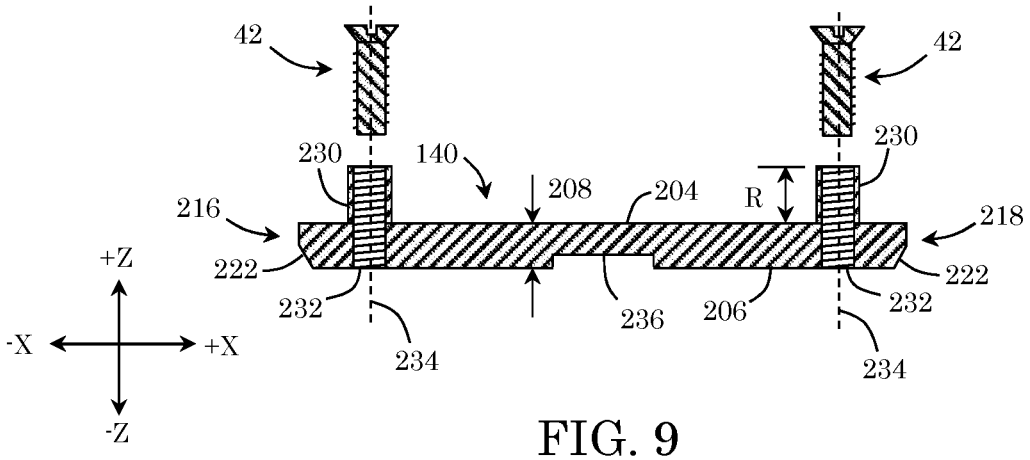
FIG. 9 is a cross sectional end view of the optical sight adapter of FIG. 6 taken along line 9-9 and illustrating the internally-threaded integral mounting posts.

As best seen in FIG. 8 showing a side cross-sectional view of optical sight adapter 200, adapter plate 202 may further comprise one or more integral mounting posts 230 extending upward (in the +Z direction) from first mounting surface 204, for example orthogonal to first mounting surface 204 a distance R above first mounting surface 204. In some embodiments, R can be equal to or greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. As depicted in FIG. 9, adapter plate 202 can comprise two integral mounting posts 230, although more than two mounting posts 230 are contemplated in further embodiments, such as three mounting posts 230 or four mounting posts 230.

Figure 10:
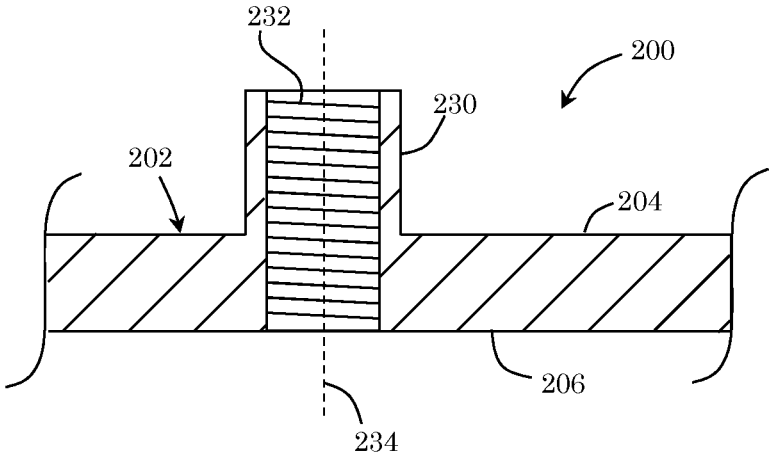
FIG. 10 is a close-up view of an internally-threaded integral mounting post.

Mounting posts 230 may, in some embodiments, be positioned such that apertures 228 are positioned between mounting posts 230 and registration pins 226. For example, within a rear half of adapter plate 202. As best seen in FIG. 10, each mounting post 230 can define a threaded passage 232 extending along a longitudinal axis 234 of the mounting post. In some embodiments, threaded passage 232 can extend entirely through mounting post 230 and adapter plate 202. The one or more mounting posts 230 can be sized to fit within a respective through-passage 40 of optical sight 10, extending upward into the through-passage, wherein threaded fastener 42 can be used to couple optical sight 10 to optical sight adapter 200. That is, threaded fastener 42 can be inserted into through-passage 40 and engaged with mounting post 230 via threaded passage 232, thereby providing coupling of optical sight 10 to optical sight adapter 200. Mounting posts 230 can provide an extended engagement compared to a threaded aperture extending through a thin adapter plate only. That is, mounting post 230 extends above first mounting surface 204 and can provide greater thread count for a threaded fastener to engage with than adapter plates that offer threaded apertures that extend only through a thickness of the adapter plate itself, thereby increasing a strength of the engagement. Additionally, because one or more mounting posts 230 are configured to extend into a respective through-passage 40 of optical sight 10, optical sight 10 may be able to more robustly withstand the shock associated with slide recoil without the optical sight shifting position. FIG. 10 is a close-up cross-sectional view showing mounting post 230 and threaded passage 232 extending along longitudinal axis 234.

To mount optical sight 10 to slide 104, optical sight adapter 200 is first secured within recessed area 118 by inserting optical sight adapter 200 into recessed area 118 so that second mounting surface 206 of optical sight adapter 200 contacts bottom surface 120 of recessed area 118. If recessed area 118 comprises an orientation feature, such as orientation feature 126, for example a raised ridge, a complementary feature on second mounting surface 206, such as recessed channel 236 located in bottom surface 206 can be engaged with the orientation feature. With optical sight adapter 200 in place in recessed area 118, optical sight adapter 200 can be coupled to slide 104 by inserting threaded fasteners 124 through apertures 228 and into engagement with threaded passages 122. The threaded fasteners may thereafter be tightened.

Once optical sight adapter 200 is coupled to slide 104, optical sight 10 can be positioned on optical sight adapter 200 so registration pins 226 are received into recesses 44, mounting posts 230 are received into through-passages 40 from bottom mounting surface 16 of optical sight 10, and threaded fasteners 42 are inserted into through-passages 40 and engaged with mounting posts 230 via threaded passages 232. The threaded fasteners 42 are then tightened to secure optical sight 10 to optical sight adapter 200.

Figure 11:
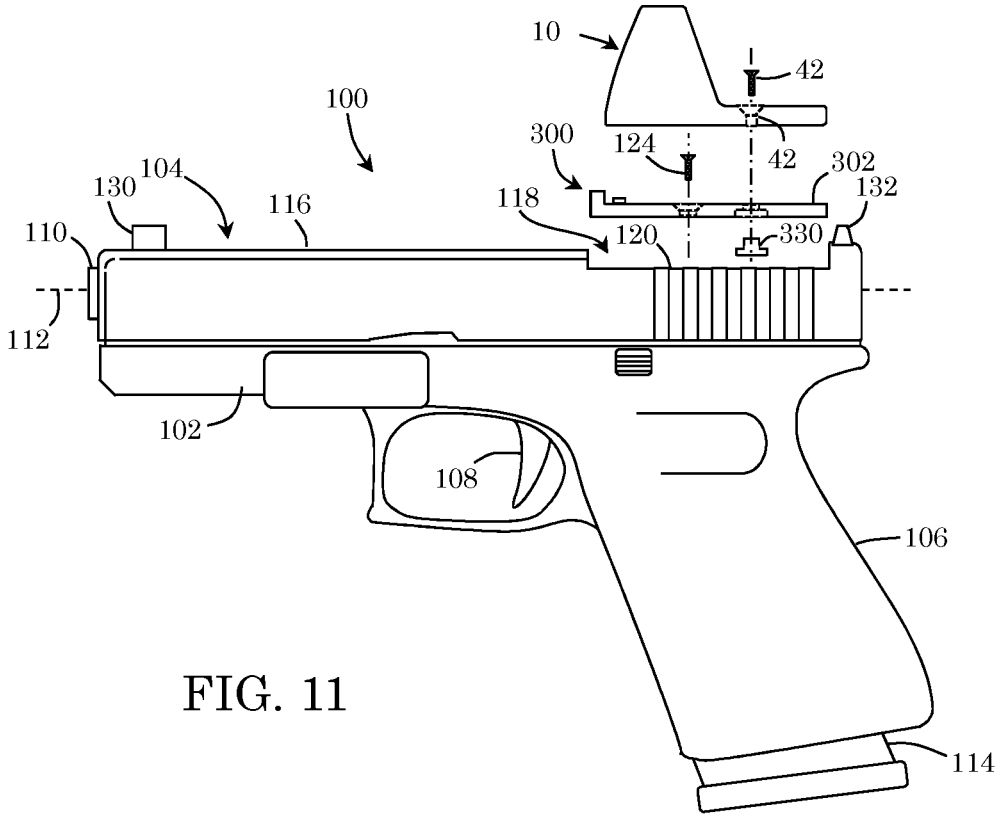
FIG. 11 is a side, partially exploded, schematic view of an exemplary handgun including another embodiment of an optical sight adapter and an optical sight mounted to the handgun with the optical sight adapter.

Turning now to FIG. 11, another embodiment of handgun 100 is shown, including an exemplary optical sight adapter 300 for mounting optical sight 10 to handgun 100. As seen in FIGS. 12-18, optical sight adapter 300 can comprise a generally rectangular adapter plate 302 comprising a first (upper) mounting surface 304 (FIG. 12), a second (lower) mounting surface 306 (FIG. 14), and a thickness 308 defined between first mounting surface 304 and second mounting surface 306 along a normal to at least one of the first or second mounting surfaces (see FIG. 13). In various embodiments, first mounting surface 304 and second mounting surface 306 can be parallel to each other. Thickness 308 of adapter plate 302 can be in a range from about 2 mm to about 4 mm, for example in a range from about 2.0 mm to about 3.5 mm, such as in a range from about 2.0 mm to about 3.0 mm, in a range from about 2.0 mm to about 2.5 mm, in a range from about 2.0 mm to about 2.4 mm, in a range from about 2.0 mm to about 2.2 mm, in a range from about 2.3 mm to about 4.0 mm, in a range from about 2.5 mm to about 4.0 mm, in a range from about 2.7 to about 4.0 mm, or in a range from about 3.0 mm to about 4.0 mm, including all ranges and subranges therebetween. In various embodiments, first mounting surface 304 and second mounting surface 306 can be generally planar. Optical sight adapter 300 can be formed of a polymer (plastic) material, such as a polycarbonate or acrylonitrile butadiene styrene (ABS), for example by injection molding or 3D printing. However, in further embodiments, optical sight adapter 300 can be metal, for example machined, cast, or 3D-printed metal, such as but not limited to aluminum or an aluminum alloy.

Optical sight adapter 300 further comprises a forward end 310 and a rear end 312 defining a length 314 therebetween, and side edge surfaces 316 and 318 defining a width 320 therebetween orthogonal to length 314. Length 314 and width 320 will depend on the design of slide 104 and more particularly the length and width of recessed area 118 and the length and width of optical sight 10. However, in some embodiments, length 314 can be in a range from about 4 cm to about 6 cm, for example in a range from about 4.2 cm to about 5.5 cm, such as in a range from about 4.5 cm to about 5.2 cm, including all ranges and subranges therebetween, and width 320 can be in a range from about 2.5 cm to about 3 cm, for example in a range from about 2.6 cm to about 2.8 cm, including all ranges and subranges therebetween. Side edge surfaces 316, 318 can, in various embodiments, be flat surfaces and extend parallel to one another. However, in further embodiments, side edge surfaces 316, 318 may include channels, raised areas, or other gripping features used to manipulate slide 104. Such gripping features may correspond to similar gripping features located on slide 104. As described in the previous embodiment, sharp edges on adapter plate 302 may cause injury to the shooter as the slide reciprocates during discharge of the handgun. Accordingly, in some embodiments, at least one of first side edge surface 316 or second side edge surface 318 may comprise a chamfer 322 (see FIG. 15). Chamfer 322 may connect with second mounting surface 306 but not first mounting surface 304, although in further embodiments, chamfer 322 may connect to both the first mounting surface and the second mounting surface. That is, only a portion of first side edge surface 316 and/or second side edge surface 318 may be chamfered, such as a bottom portion of each side edge. In addition, chamfer 322 can provide a transition from a width of recessed area 118 to a width of optical sight 10. That is, in some embodiments, a width of optical sight 10 (in a direction orthogonal to longitudinal axis 112) may be greater than a width of recessed area 118. Thus, chamfer 322 can provide both a functional and an aesthetic transition from the width of the recessed area to the width of the optical sight.

Optical sight adapter 300 further comprises an integral recoil buffer 324 positioned at forward end 310 and extending upright (upward in the +Z direction) from first mounting surface 304. Recoil buffer 324 can space optical sight 10 from forward surface 140 and provide forward support to the optical sight during recoil of slide 104. Accordingly, rear-facing support surface 326 may have a shape complementary to forward end 26 of optical sight 10 so that when optical sight 10 is mounted on optical sight adapter 300, supporting contact between forward end 26 of optical sight 10 and support surface 326 can be maximized. A width 327 of recoil buffer 324 can be at least 0.5 times width 320, for example at least about 0.75 times width 320. In some embodiments, width 327 of recoil buffer 324 can be equal to width 320.

First mounting surface 304 can be configured to engage with bottom mounting surface 16 of optical sight 10, while second mounting surface 306 can be configured to engage with bottom surface 120 of recessed area 118. Accordingly, optical sight adapter 300, and in particular, adapter plate 302, can function as a mating interface between slide 104 and optical sight 10. For example, first mounting surface 304 may comprise one or more registration pins 328 extending upward (in the +Z direction), for example orthogonally, from first mounting surface 304. Registration pins 328 can be sized and configured to be received within recesses 44 of optical sight 10. Additionally, adapter plate 302 may include one or more apertures 330 for coupling optical sight adapter 300 to recessed area 118 via threaded fasteners 124. Apertures 330 may comprise a chamfered upper surface connecting to first mounting surface 304. That is, the one or more apertures 330 may be countersunk to receive a fastener head, e.g., screw head.

Figure 16A:
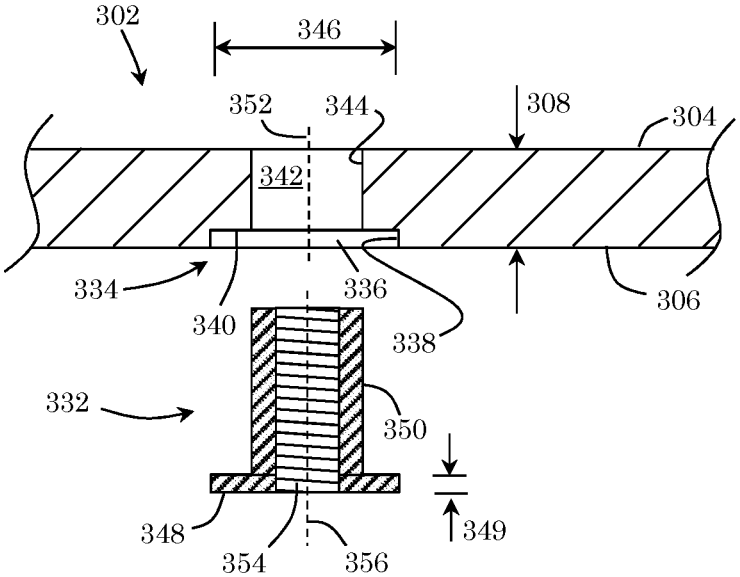
FIG. 16A is a close-up exploded view of a socket and removable mounting post of FIG. 15.
Figure 16B:
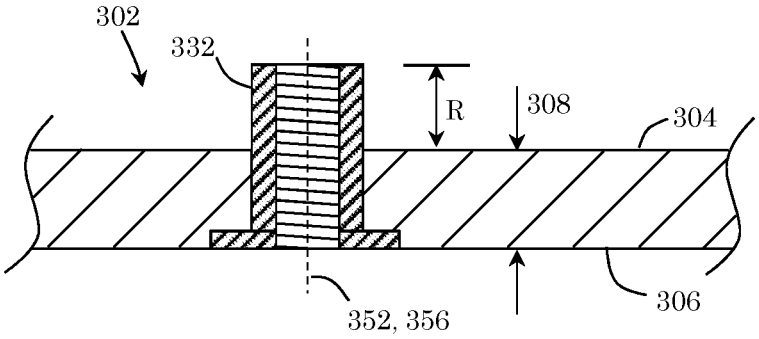
FIG. 16B is a close-up view of the socket and removable mounting post of FIG. 16A showing the removable mounting post inserted in the socket.

Referring to FIGS. 16A and 16B, in various embodiments, adapter plate 302 may further comprise one or more mounting posts 332 removably engaged in sockets 334 in second mounting surface 306, sockets 334 extending between second mounting surface 306 and first mounting surface 304. By removably engaged what is meant is that mounting posts 332 are friction-fit (e.g., an interference fit) within sockets 334 such that when mounting posts 332 are engaged in sockets 334, the mounting posts will not drop from the sockets under their own weight when second mounting surface 306 is horizontal and facing down, but can be removed without damaging adapter plate 302 by applying an axial force against a top of a mounting post extending above first mounting surface 304. When engaged with socket 334, mounting post 332 extends distance R above first mounting surface 304, wherein R can be can be equal to or greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm, including all ranges and subranges therebetween.

Referring to FIG. 16A, each of the one or more sockets 334 can comprise a recess 336 in second mounting surface 306, recess 336 defined by side wall 338 and bottom wall 340. FIG. 16A is a close-up cross-sectional view of socket 334 and mounting post 332 disengaged from socket 334. FIG. 16B is a close-up cross-sectional view of socket 334 shown in FIG. 16A with mounting post 332 engaged with socket 334. Each of the one or more sockets 334 may further comprise an aperture 342, for example a cylindrical aperture, extending from the bottom wall 340 through first mounting surface 304, aperture 342 comprising side surface 344. In embodiments, side surface 344 can be smooth. To wit, side surface 344 of aperture 342 may not be threaded. In various embodiments, a minimum lateral dimension 346 of recess 336, for example width 341 shown in FIG. 14, can be larger than a diameter of aperture 342.

Figure 14:
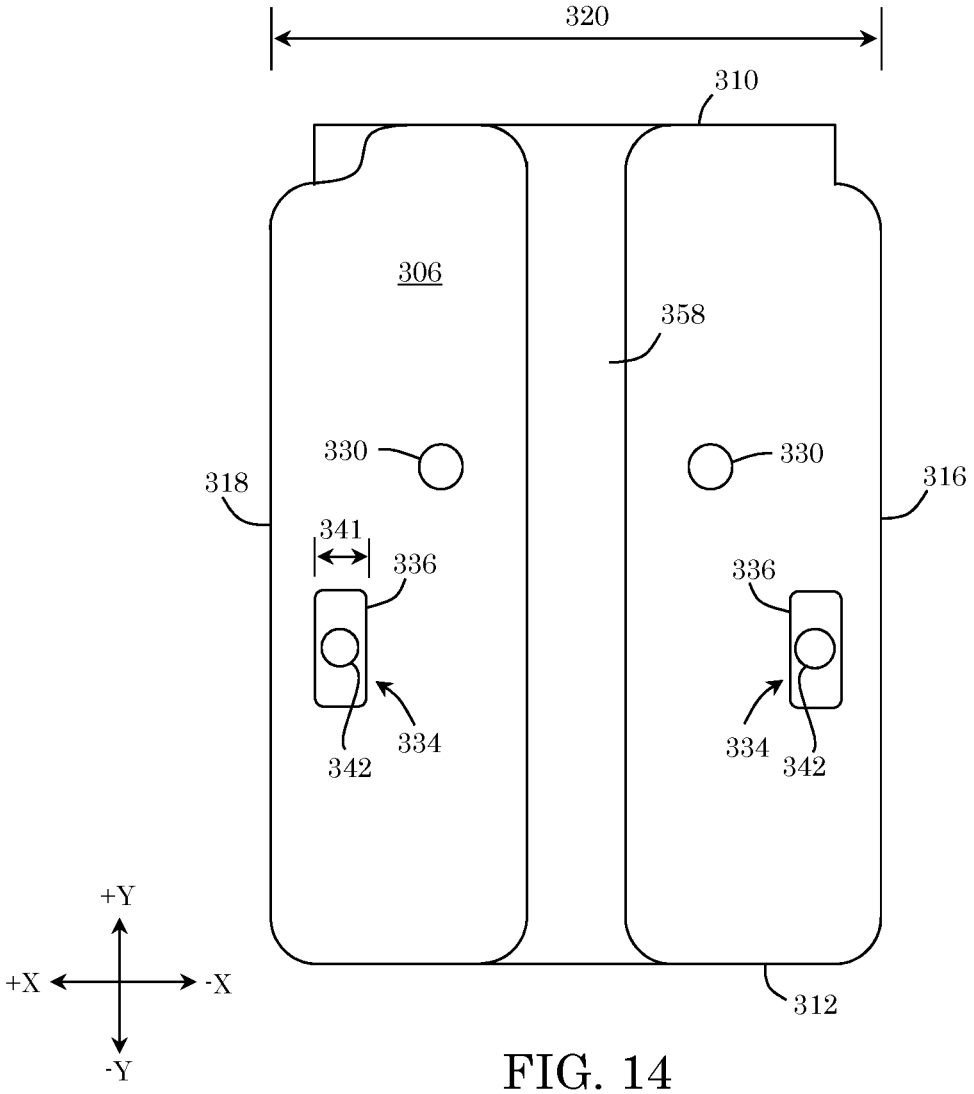
FIG. 14 is a schematic view of a lower mounting surface of the optical sight adapter of FIG. 11.
Figure 15:
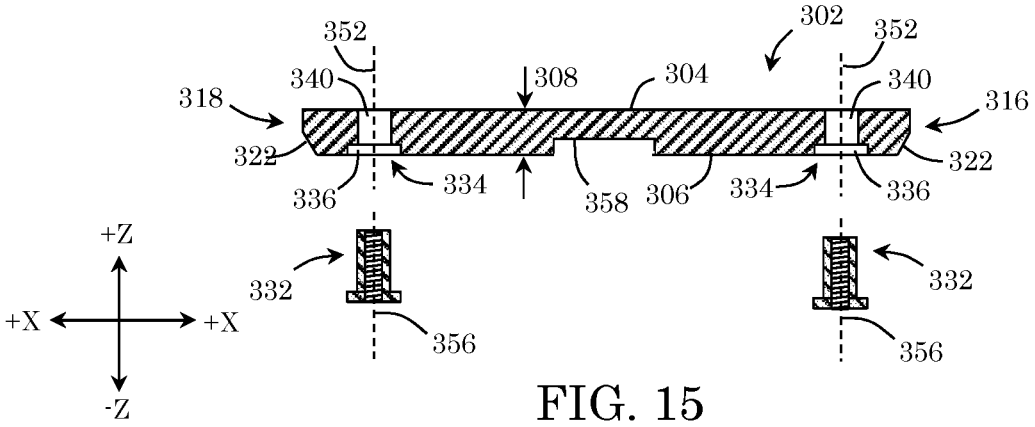
FIG. 15 is a cross-sectional view of the optical sight adapter of FIG. 12 taken along line 15-15 illustrating sockets and removable mounting posts.

Recess 336 may have a variety of possible peripheral geometric shapes. For example, recess 336 may have a generally rectangular shape as shown in FIG. 14. Corners of the shape may be radiused. However, in further embodiments, recess 336 can have a star-shaped peripheral shape, an elliptical peripheral shape, a triangular peripheral shape, a pentagonal peripheral shape, and the like. In some embodiments, recess 336 can have a circular geometric shape as described farther below. Recess 336 may not be circularly symmetric with reference to longitudinal axis 352. That is, recess 336 may be circularly asymmetric with reference to longitudinal axis 352. As used herein, circularly symmetric means that for a line segment extending from and orthogonal to longitudinal axis 352 and terminating at side wall 338, as the line segment is rotated about longitudinal axis 352 a length of the line segment does not vary. Accordingly, circularly asymmetric means that for a line segment extending from and orthogonal to longitudinal axis 352 and terminating at side wall 338, as the line segment is rotated about longitudinal axis 352 a length of the line segment varies. It should be noted that a circular recess 336 with a center positioned such that longitudinal axis 352 passes through the center is circularly symmetric. However, if the center of the circle is offset from longitudinal axis 352 such that recess 336 is positioned eccentrically relative to longitudinal axis 352, the recess would be circularly asymmetric. Accordingly, in some embodiments, recess 336 may be circular if the recess is arranged eccentrically relative to longitudinal axis 352. That is, such that the circular recess is not concentric with aperture 342.

Figure 17:
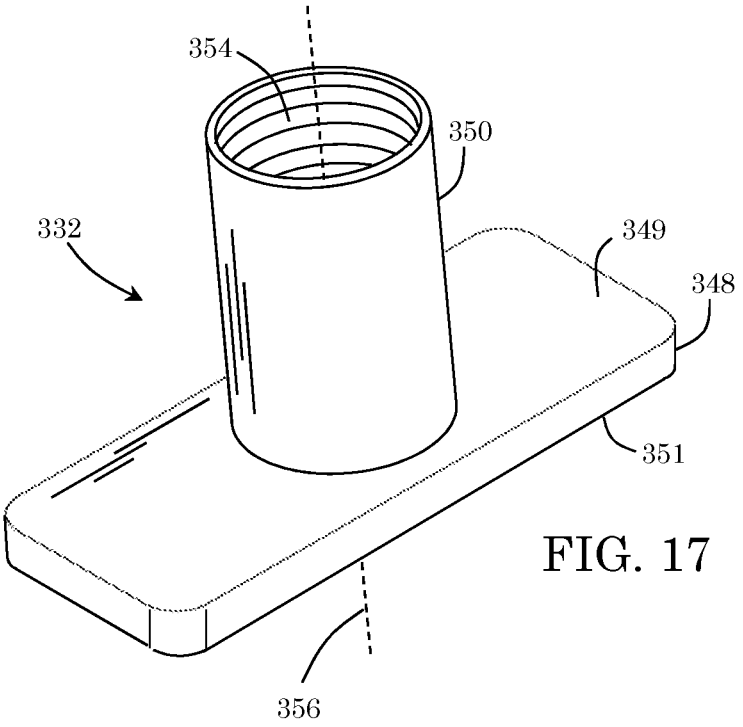
FIG. 17 is a perspective view of an exemplary removable mounting post comprising a generally rectangular flange in according to embodiments of the present disclosure.
Figure 18:
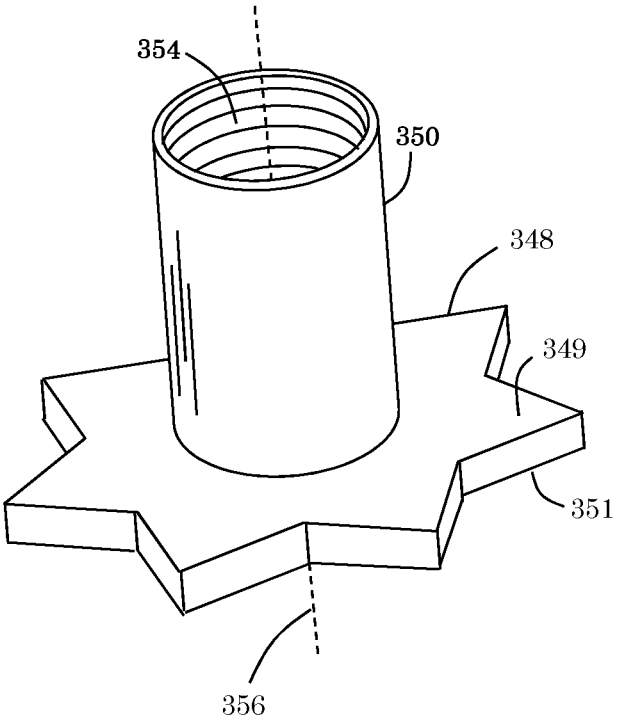
FIG. 18 is a perspective view of another exemplary removable mounting post comprising a star flange according to embodiments of the present disclosure.

As described above, mounting post 332 can be removably engaged with socket 334, wherein mounting post 332 provides a friction fit with socket 334. Mounting post 332 can comprise a flange 348 and a shaft 350 extending from the flange. A shape of flange 348 can be complementary to the shape of recess 336. That is, flange 348 can have the same geometric shape as recess 336 and be sized to provide a friction fit within recess 336. In other words, where recess 336 comprises a generally rectangular shape, mounting post 332 may also comprise a flange 348 with a generally rectangular shape, as shown in FIG. 17, the flange sized to provide a friction fit within recess 336 such that mounting post 332 is retained in socket 334. However, like recess 336, flange 348 may have other geometric shapes that match the geometric shape of recess 336, such as, by way of example and not limitation, a star shape as shown in FIG. 18. Other shapes for flange 348 can include triangular, polygonal (e.g., pentagonal), elliptical, ovoid, or even circular under conditions described above. In some embodiments, major surfaces 349 and 351 of flange 348 may be planar, without protrusions. In addition, shaft 350 can have a geometric cross-sectional shape and/or size (e.g., outer diameter) that is about the same as the geometric shape as the interior shape of aperture 342. For example, if aperture 342 comprises a cylindrical shape with a circular cross-section orthogonal to longitudinal axis 352 of aperture 342, shaft 350 can also have a circular cross-sectional shape. According to some embodiments, shaft 350 may have a smooth exterior surface without protrusions. In some embodiments, an outside cross-sectional dimension of shaft 350 may be sized to provide a friction fit with side surface 344 of aperture 342, although such friction fit may not be necessary if flange 348 provides a sufficient friction fit with recess 336. In some embodiments, it may be sufficient to provide a friction fit between shaft 350 and aperture 342 and not between flange 348 and recess 336, while in still other embodiments, a friction fit may be provided between both flange 348 and recess 366, and between shaft 350 and aperture 342. In some embodiments, flange 348 can have a thickness 349 in a range from about 1 mm to about 1.5 mm, for example in a range from about 1.15 to about 1.25 mm, including all ranges and subranges therebetween.

Each mounting post 332 comprises a threaded passage 354 extending along a longitudinal axis 356 of the mounting post. In some embodiments, threaded passage 354 can extend entirely through mounting post 332, although in further embodiments, threaded passage 354 may extend through a portion or all of shaft 350 but not flange 348. The one or more mounting posts 332 can be sized to fit within through-passage 40 of optical sight 10, extending upward into the through-passage when optical sight is mounted to optical sight adapter 300. Threaded fastener 42 can thereafter be used to couple optical sight 10 to optical sight adapter 300. That is, threaded fastener 42 can be inserted into through-passage 40 and engaged with mounting post 332 via threaded passage 354, thereby coupling optical sight 10 to optical sight adapter 300. Mounting post 332 can provide an extended engagement compared to a threaded passage extending through a thin adapter plate only. That is, because a length of mounting post 332 is greater than thickness 308 of adapter plate 302, mounting post 332 can provide greater thread engagement for a threaded fastener, thereby increasing the strength of the engagement. Additionally, because mounting post 332 is configured to extend into through-passage 40 of optical sight 10, optical sight 10 may be able to more robustly withstand the shock associated with slide recoil without the optical sight shifting position. Moreover, because mounting posts 332 are removable without damaging the optical sight adapter, if a mounting post is damaged (e.g., broken), the damaged mounting post can be individually replaced without discarding and replacing the entire optical sight adapter. Removable mounting post 332 may be formed from stainless steel or other suitable corrosion-resistant metal to prevent corrosion of the mounting post, and when combined with a polymer adapter plate and recoil buffer, optical sight adapter 300 can provide a lightweight but strong mounting apparatus for mounting optical sight 10 to handgun 100.

In various embodiments, mounting post 332 can be configured to resist rotation of the mounting post 332 about longitudinal axis 352 when a torque is applied to the mounting post. That is, flange 348 can be circularly asymmetric relative to longitudinal axis 356 such that a line segment extending orthogonally from longitudinal axis 356 and terminating at a periphery of flange 348 varies in length as the line segment is rotated about longitudinal axis 356. Moreover, when mounting post 332 is engaged in socket 334 and longitudinal axis 356 is coaxial with longitudinal axis 352, flange 348 is circularly asymmetric relative to longitudinal axis 352. This configuration ensures that if a torque is applied to mounting post 332 engaged in socket 334 with longitudinal axis 356 coaxial with longitudinal axis 352, flange 348 is unable to turn within complementarily-shaped recess 336. In some embodiments, flange 348 may be circular and still resist rotation if a longitudinal axis of the circular flange is offset from longitudinal axis 352 as previously described. Put another way, flange 348 should be configured such that the flange (e.g., a periphery thereof) is circularly asymmetric relative to longitudinal axis 352.

Figure 12:
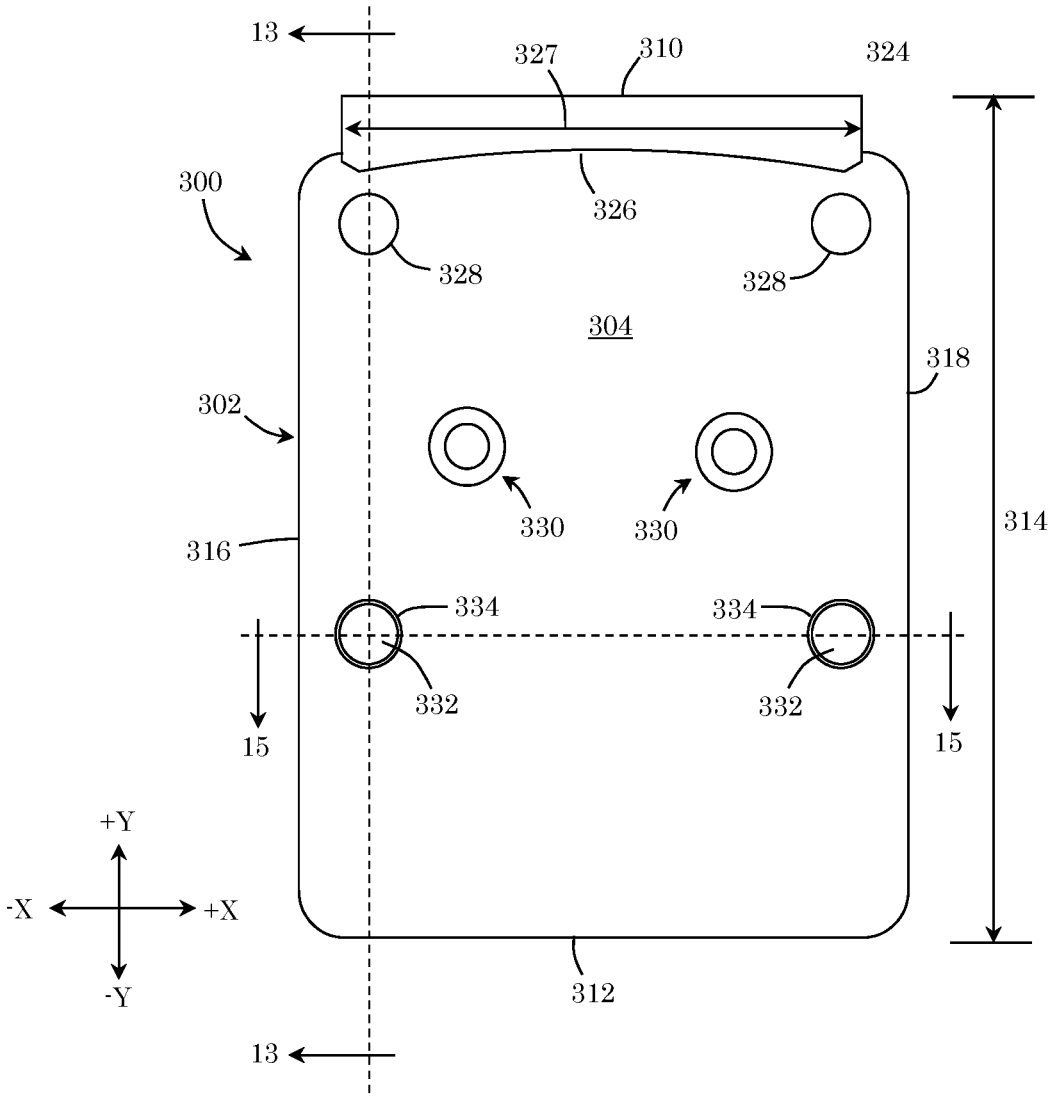
FIG. 12 is a schematic view of an upper mounting surface of the optical sight adapter of FIG. 11.
Figure 13:
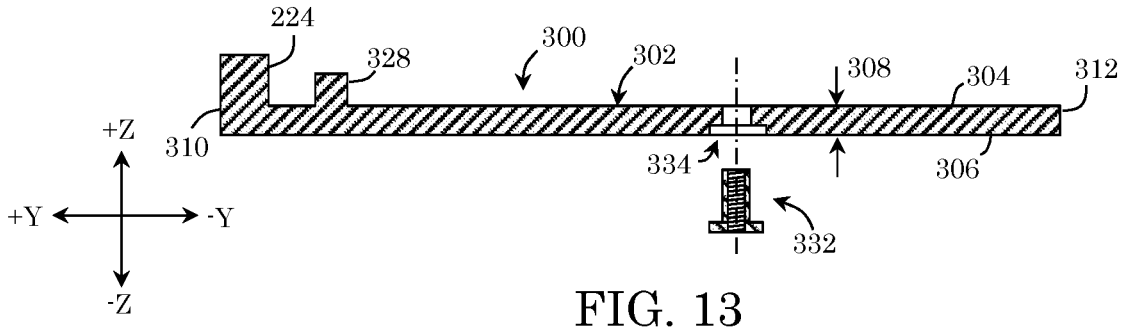
FIG. 13 is a cross-sectional view of the optical sight adapter of FIG. 12 taken along line 13-13 illustrating apertures configured to receive removable mounting posts.

To mount optical sight 10 to slide 104, optical sight adapter 300 can be secured within recessed area 118 by inserting mounting post 332 into socket 334 so that shaft 350 extends above first mounting surface 304, then inserting optical sight adapter 300 into recessed area 118 so that second mounting surface 306 of optical sight adapter 300 contacts bottom surface 120 of recessed area 118. Accordingly, mounting post 332 is captured between socket 334 and bottom surface 120 of recessed area 118. If recessed area 118 comprises an orientation feature 126, for example a raised ridge, a complementary feature on second mounting surface 306, such as recessed channel 358, can be engaged with orientation feature 126. With optical sight adapter 300 in place in recessed area 118, optical sight adapter 300 can be secured to slide 104 by inserting threaded fastener 124 through aperture 330 and into engagement with threaded passages 122, and then tightening the threaded fastener. As shown in FIGS. 12 and 14, optical sight adapter 300 may include a plurality of apertures 330, for example a pair of apertures 330.

Once optical sight adapter 300 is secured to slide 104, optical sight 10 can be positioned on optical sight adapter 300 so that registration pins 328 are received into recesses 44, and mounting post 332 is received into through-passage 40. Threaded fastener 42 can then be inserted into through-passage 40 and engaged with mounting post 332 via threaded passage 354 and the threaded fastener thereafter tightened to secure optical sight 10 to optical sight adapter 300. As shown in FIGS. 12 and 14, optical sight adapter 300 may include a plurality of mounting posts 332, for example a pair of mounting posts 332.

Figure 19:
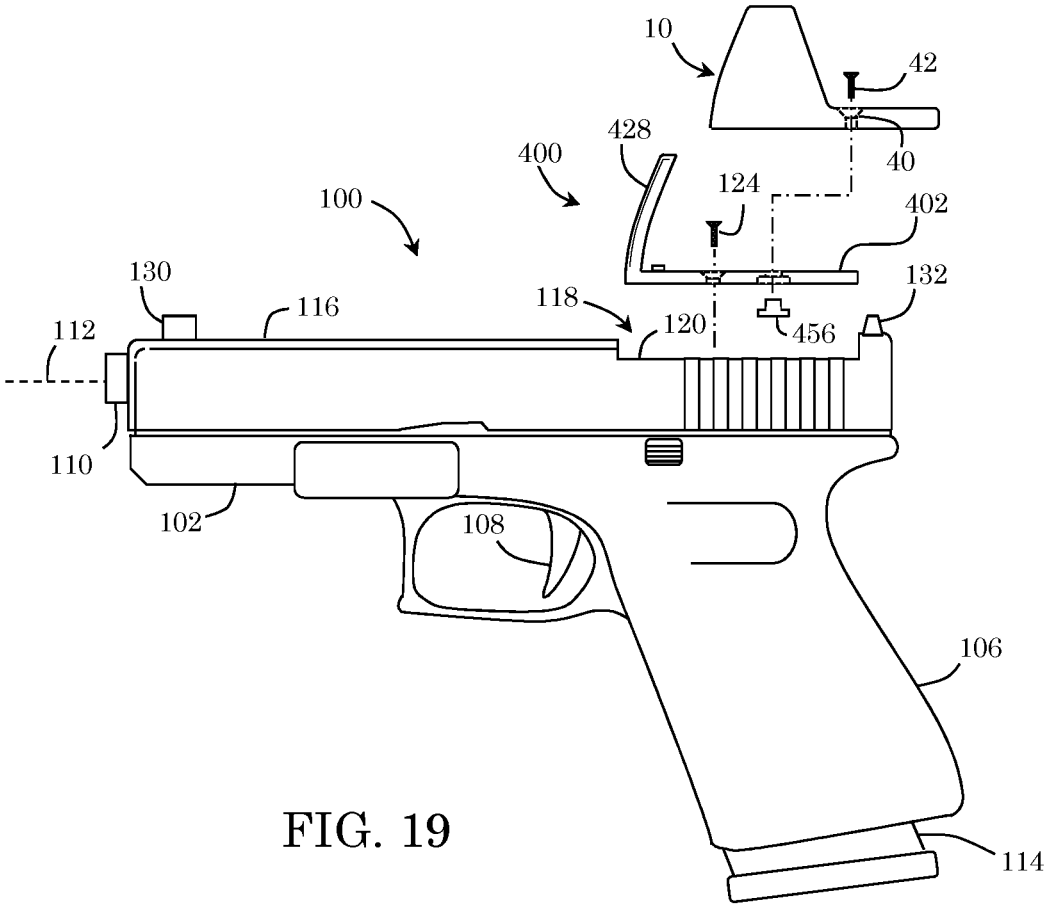
FIG. 19 is a side, partially exploded, schematic view of an exemplary handgun including another embodiment of an optical sight adapter and an optical sight mounted to the handgun with the optical sight adapter.
Figure 20:
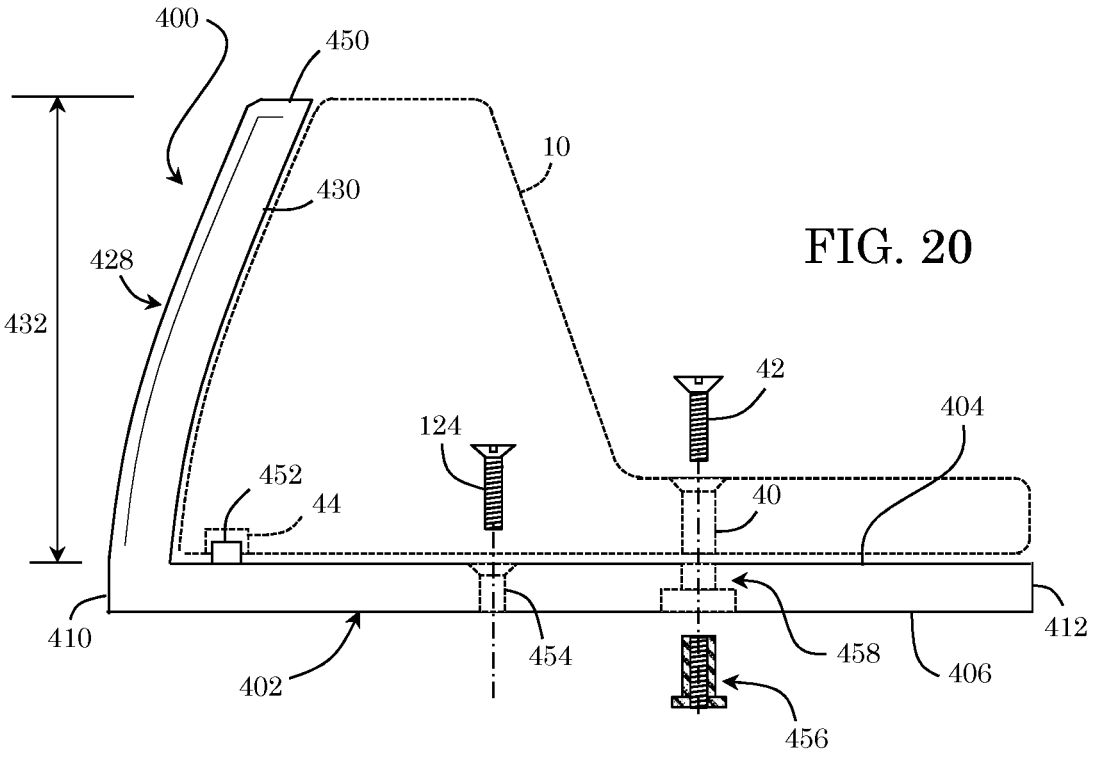
FIG. 20 is a schematic side view of the optical sight adapter of FIG. 19 showing the socket and removable mounting post, the removable mounting post shown in cross-section.

Turning now to FIG. 19, handgun 100 is shown including another exemplary optical sight adapter 400 for mounting optical sight 10 to handgun 100. As shown FIGS. 20-24 and 25A-25B, optical sight adapter 400 according to some embodiments comprises a generally rectangular adapter plate 402 comprising a first (upper) mounting surface 404 (FIG. 22), a second (lower) mounting surface 406 (FIG. 23), and a thickness 408 defined between first mounting surface 404 and second mounting surface 406 along a normal to at least one of the first or second mounting surfaces (see FIG. 24). In various embodiments, thickness 408 of adapter plate 402 can be in a range from about 2 mm to about 4 mm, for example in a range from about 2.0 mm to about 3.5 mm, such as in a range from about 2.0 mm to about 3.0 mm, in a range from about 2.0 mm to about 2.5 mm, in a range from about 2.0 mm to about 2.4 mm, in a range from about 2.0 mm to about 2.2 mm, in a range from about 2.3 mm to about 4.0 mm, in a range from about 2.5 mm to about 4.0 mm, in a range from about 2.7 to about 4.0 mm, or in a range from about 3.0 mm to about 4.0 mm, including all ranges and subranges therebetween.

In various embodiments, first mounting surface 404 and second mounting surface 406 can be parallel to each other. In various embodiments, first mounting surface 404 and second mounting surface 406 can be generally planar. In some embodiments optical sight adapter 400 can be formed of a polymer (plastic) material, such as a polycarbonate or acrylonitrile butadiene styrene (ABS), for example by injection molding or 3D printing. However, in further embodiments, optical sight adapter 400 can be metal, for example machined, cast, or 3D-printed metal, such as but not limited to aluminum or an aluminum alloy. Optical sight adapter 400 further comprises a first (forward) end 410 and a second (rear) end 412 defining a length 414 therebetween, and side edge surfaces 416 and 418 defining a width 420 therebetween orthogonal to length 414. Length 414 and width 420 will depend on the design of slide 104 and more particularly the length and width of recessed area 118 and the length and width of optical sight 10. However, by way of example and not limitation, in some embodiments, length 414 can be in a range from about 4 cm to about 6 cm, for example in a range from about 4.2 cm to about 5.5 cm, such as in a range from about 4.5 cm to about 5.2 cm, including all ranges and subranges therebetween. Width 420 can be in a range from about 2.5 cm to about 3 cm, for example in a range from about 2.6 cm to about 2.8 cm, including all ranges and subranges therebetween. Side edge surfaces 416, 418 can, in various embodiments, be flat surfaces and extend parallel to one another. However, in further embodiments, side edge surfaces 416, 418 may include channels, raised areas, or other gripping features used to manipulate slide 104. Such gripping features may correspond to similar gripping features located on slide 104. As previously described, sharp edges on adapter plate 402 may cause injury to the shooter as the slide reciprocates during discharge of the handgun. Accordingly, in some embodiments, at least one of first side edge surface 416 or second side edge surface 418 may comprise a chamfer 422 (see FIG. 24). For example, chamfer 422 may connect with second mounting surface 406 but not first mounting surface 404, although in further embodiments, chamfer 422 may connect to both the first mounting surface and the second mounting surface. That is, only a portion of first side edge surface 416 and/or second side edge surface 418 may be chamfered, such as a bottom portion of the side edge surfaces. In addition, chamfer 422 can provide a transition from a width of the slide recessed area to a width of optical sight 10. That is, in some embodiments, a width of optical sight 10 (in a direction orthogonal to longitudinal axis 112) may be greater than a width of recessed area 118. Thus, chamfer 422 can provide both a functional and an aesthetic transition from the width of the recessed area to the width of the optical sight.

In some embodiments, first end 410 may further comprise a recess 424 (see FIGS. 21A and 21B) connected to second mounting surface 406 and extending in a width-wise direction (−X, +X) across at least a portion of first end 410. Recess 424 can be configured to receive upper surface 116 of slide 104 when optical sight adapter 400 is mounted in recessed area 118. That is, recess 424 is sized and positioned such that when optical sight adapter 400 is mounted in recessed area 118, at least a portion of slide 104 can be inserted into recess 424 and upper wall 426 of recess 424 extends over a portion of slide 104, e.g., slide upper surface 116.

Optical sight adapter 400 further comprises an integral recoil buffer 428 positioned at first (forward) end 410 and extending generally upright from first mounting surface 404. Thus, recoil buffer 428 and adapter plate 402 form a stiff, one-piece structure. Recoil buffer 428 can be configured to function as a spacer between optical sight 10 and forward surface 140 of recessed area 118, to provide support to optical sight 10 during recoil of slide 104, and to protect optical element 20 by recessing optical element 20 behind (rearward from) the recoil buffer. Accordingly, recoil buffer 428 comprises a rear-facing support surface 430 with a shape complementary to forward end 26 of optical sight 10 so that when optical sight 10 is mounted on optical sight adapter 400, supporting contact between a forward surface of optical sight 10 (e.g., including a forward surface of canopy 18) and support surface 430 is maximized.

In some embodiments, a height 432 of recoil buffer 428 from first mounting surface 404 can be greater than about 0.25 times length 414, for example greater than about 0.3 times length 414, although other heights are contemplated. A width 433 of recoil buffer 428 can be at least 0.5 times width 420 of adapter plate 402, for example at least 0.75 times width 420, such as 0.8 times width 420. In some embodiments, a width of recoil buffer 428 can be equal to width 420. Recoil buffer 428 can be about the same height above first mounting surface 404 as a height of optical sight 10 above first mounting surface 404 when optical sight 10 is mounted to optical sight adapter 400. Recoil buffer 428 may comprise a frame 434 comprising two side members 438, 440 extending from bottom member 436, and a cross-member 442 extending across a top of side members 438, 440, frame 434 defining an opening 444 sized to provide a viewing window through which a target picture can be viewed through optical sight 10 without obstructing the shooter's view of the target. Opening 444 can be sized according to optical sight 10, and in particular, opening 444 can be sized and shaped to conform to opening 46 of optical sight 10. Opening 444 may be D-shaped. In some embodiments, opening 444 can have a width 446 in a range from about 2 centimeters (cm) to about 3 cm, for example in a range from about 2 cm to about 2.8 cm, such as in a range from about 2 cm to about 2.5 cm, including all range and subranges therebetween. In some embodiments, opening 444 may have a height 448 in a range from about 1.5 cm to about 1.8 cm, such as in a range from about 1.6 cm to about 1.8 cm. Side members 438 and 440 can be directly forward of side members 48, and cross-member 442 can be directly forward of cross-member 50 when optical sight 10 is mounted on optical sight adapter 400.

Figure 21A:
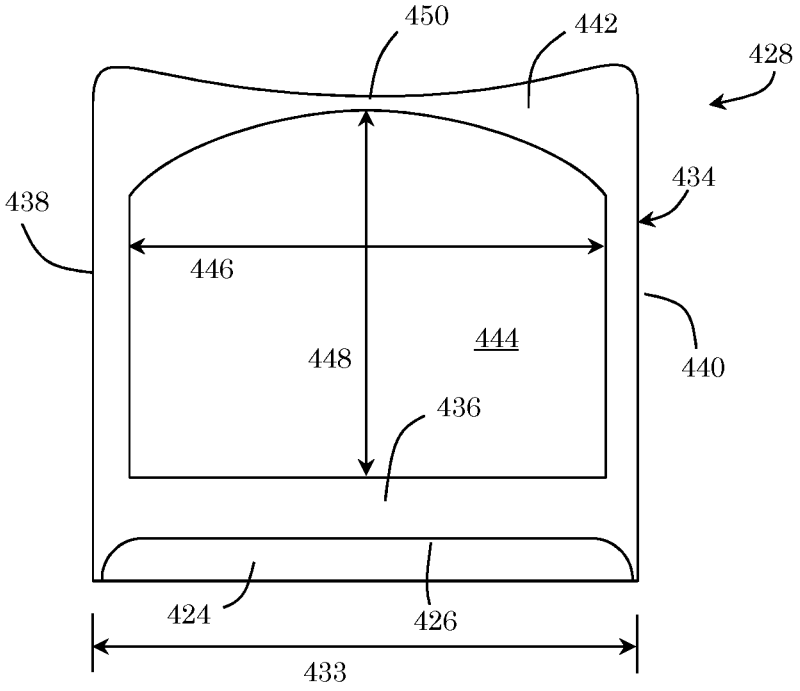
FIG. 21A is a schematic front view of the optical sight adapter of FIG. 19 comprising a downwardly concave upper surface.
Figure 21B:
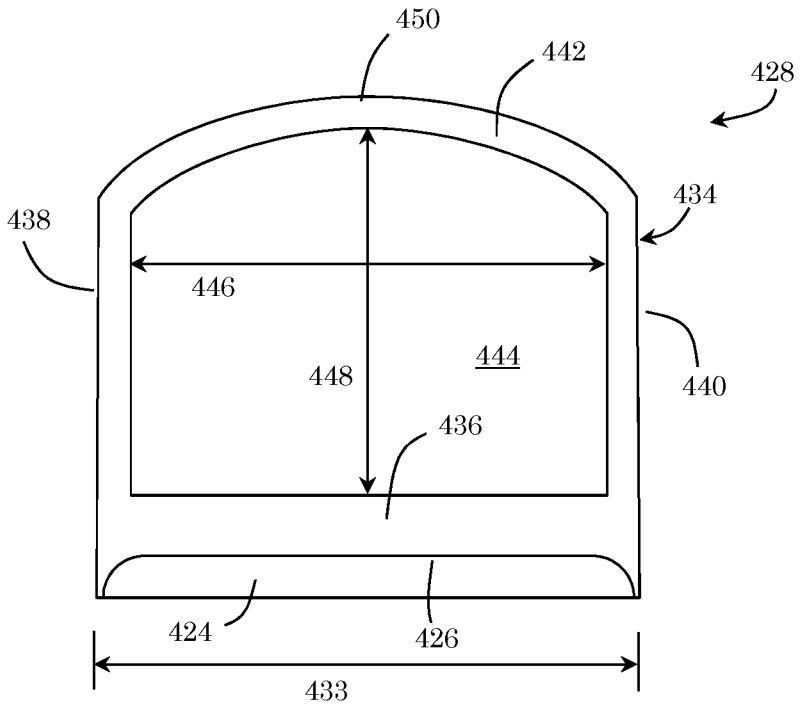
FIG. 21B is a schematic front view of the optical sight adapter of FIG. 19 comprising an upwardly convex upper surface.

In some embodiments, rear-facing support surface 430 may be flat and orthogonal to first mounting surface 404, while in further embodiments, rear-facing support surface 430 may be arcuate. In the embodiment depicted in FIG. 22, recoil buffer rear-facing support surface 430 can comprise a first, lateral curvature extending in a width-wise direction (along −X,+X axis). In some embodiments, recoil buffer rear-facing support surface 430 may further comprise a second curvature orthogonal to the first curvature (see FIG. 20). In embodiments, recoil buffer 428 can curve backward from first end 410, in a direction toward second end 412. That is, recoil buffer 428 may have a convex curvature. In some embodiments, as shown in FIG. 21A, upper surface 450 of cross-member 442 may have an additional third curvature, for example a downwardly concave curvature, although in further embodiments, shown in FIG. 21B, upper surface 450 may comprise an upwardly convex curvature.

A frequent complaint voiced in respect of prior art sight adapters is a propensity to acquire smudges on front surface 22 of optical element 20, for example from fingerprints. When light beam 32 intersects smudges on front surface 22, the light can scatter, causing a halo around the indicium that can affect aiming. Moreover, attempts to remove the smudge, by wiping for example, may result in mishandling of the firearm to which the optical sight is attached, potentially leading to inadvertent and potentially dangerous discharge of the firearm. The instant embodiment can provide additional support and protection for optical sight 10. For example, by positioning optical element 20 of optical sight 10 behind frame 434, forward-facing optical element 20 can be better protected from inadvertent frontal contact, including impact damage. That is, optical sight 10 is positioned behind recoil buffer 428 with a forward surface of canopy 18 covered by frame 434 without obstructing the shooter's view through optical sight 10. Accordingly, contact with optical element 20 may be reduced and frontal impact absorbed by recoil buffer 428 rather than optical sight 10.

Figure 22:
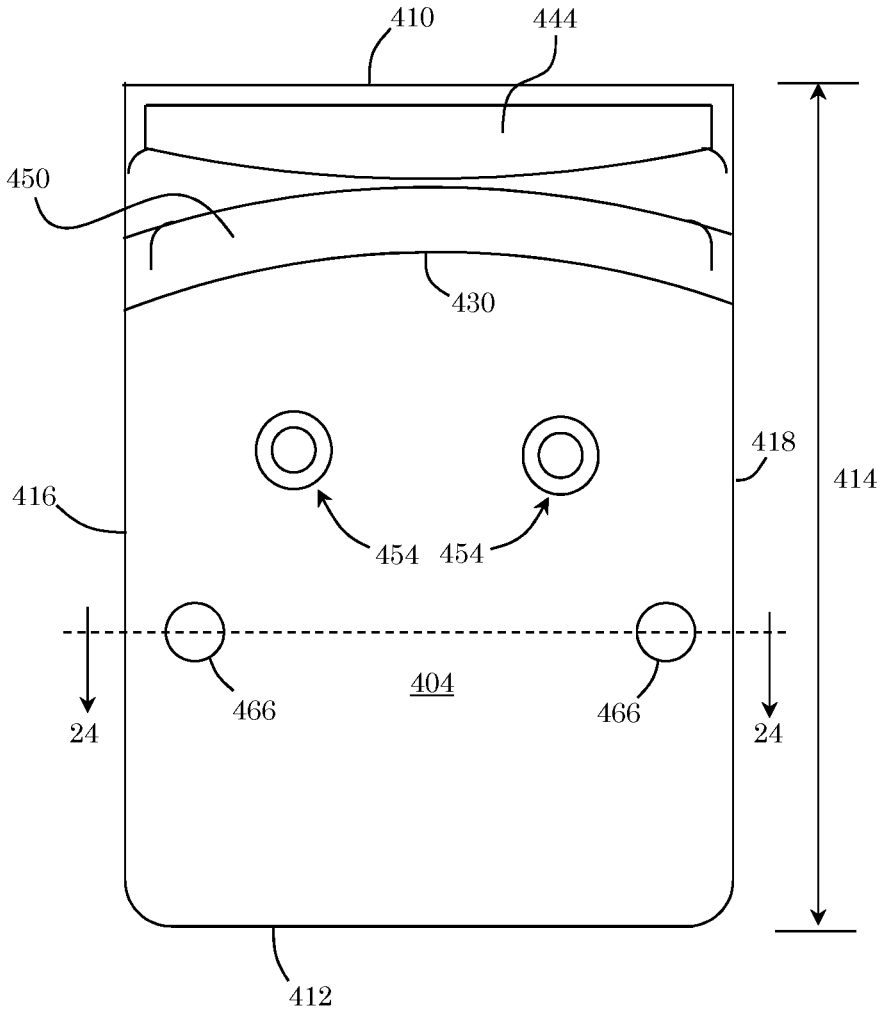
FIG. 22 is a top view of an upper mounting surface of the optical sight adapter of FIG. 19.
Figure 23:
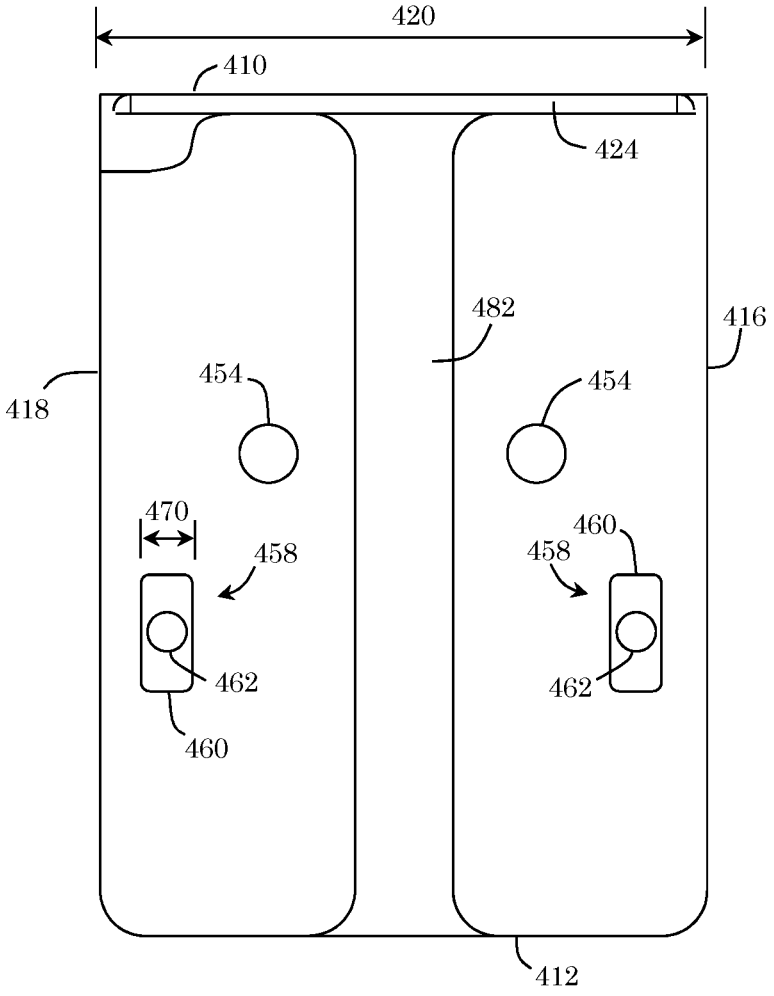
FIG. 23 is a bottom view of a lower mounting surface of the optical sight adapter of FIG. 19 showing the sockets disposed therein.
Figure 24:
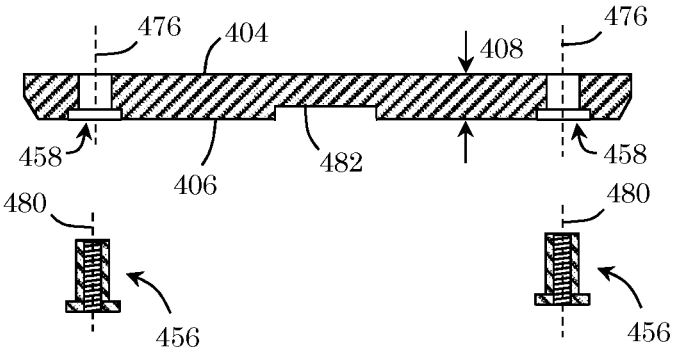
FIG. 24 is a cross-sectional view of the optical sight adapter of FIG. 19 taken along line 24-24 illustrating fastener sockets and removable mounting posts.

Referring to FIGS. 22 and 23, first mounting surface 404 is configured to engage with bottom mounting surface 16 of optical sight 10, while second mounting surface 406 is configured to engage with bottom surface 120 of recessed area 118. Accordingly, optical sight adapter 400, and in particular, adapter plate 402, functions as a mating interface between slide 104 and optical sight 10. First mounting surface 404 may comprise one or more registration pins 452 extending upward, for example orthogonally, from first mounting surface 404. Additionally, adapter plate 402 may include one or more apertures 454 for mounting optical sight adapter 400 to recessed area 118. Apertures 454 may comprise a chamfered upper surface connecting to first mounting surface 404. That is, the one or more apertures 454 may be countersunk to receive a fastener head, e.g., screw head.

In various embodiments, adapter plate 402 may further comprise one or more removable mounting posts 456 removably engaged in sockets 458 extending between second mounting surface 406 and first mounting surface 404. By removably engaged what is meant is that mounting posts 456 are friction-fit (e.g., an interference fit) within sockets 458 such that when mounting posts 456 are engaged in sockets 458, the mounting posts will not drop from the mounting sockets under their own weight when second mounting surface 406 is horizontal and facing down, but can be removed by applying an axial force against a top of a mounting post extending above first mounting surface 404. When engaged in socket 458, mounting post 456 may extend distance R above first mounting surface 404 greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. Removable mounting posts 456 may be formed from stainless steel or other suitable corrosion-resistant metal to prevent corrosion of the mounting posts, and when combined with a polymer adapter plate and recoil buffer, optical sight adapter 400 can provide a light-weight but strong mounting apparatus for mounting optical sight 10.

Figure 25A:
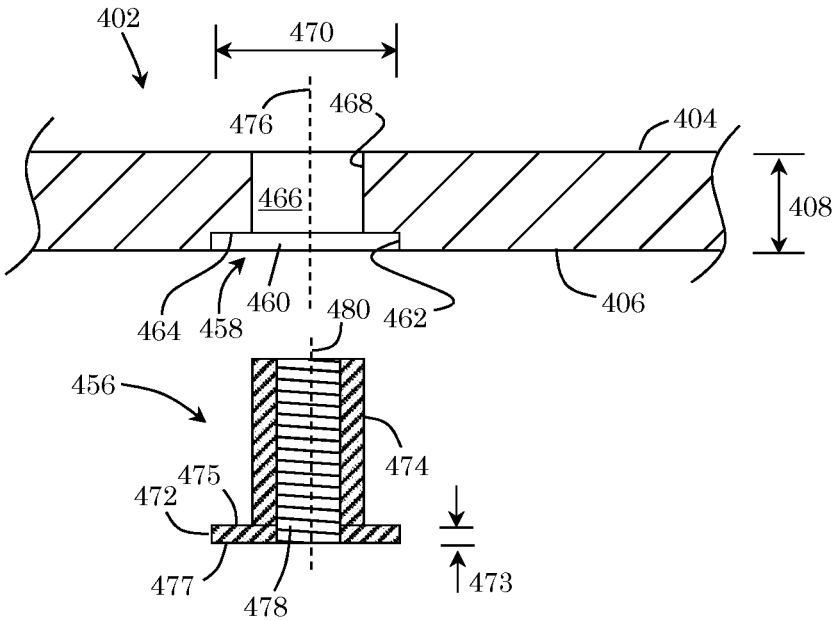
FIG. 25A is a close-up cross-sectional view of a socket and removable mounting post of FIG. 24.
Figure 25B:
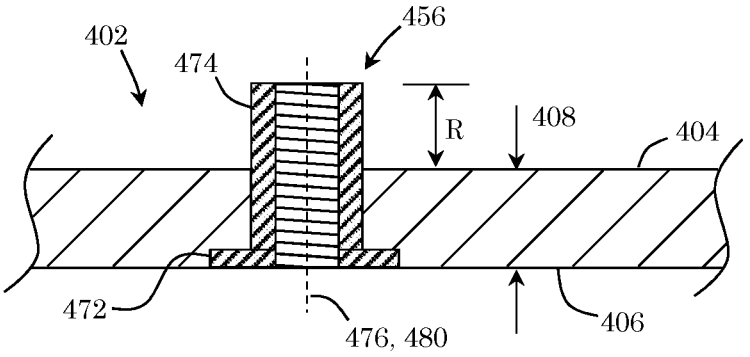
FIG. 25B is a close-up view of the socket and removable mounting post of FIG. 25A showing the removable mounting post inserted in the socket.

Referring to FIGS. 25A and 25B, each of the one or more sockets 458 comprises a recess 460 in second mounting surface 406, recess 460 defined by side wall 462 and bottom wall 464. Each of the one or more sockets 458 may further comprise an aperture 466 extending from recess bottom wall 464 through first mounting surface 404, aperture 466 comprising side surface 468. In embodiments, side surface 468 can be smooth. To wit, side surface 468 of aperture 466 may not be threaded. In various embodiments, a minimum lateral dimension 470 of recess 460 is larger than a diameter of aperture 466. FIG. 25A is a cross-sectional side view of a socket 458 and a mounting post 456 shown disengaged from the socket, while FIG. 25B is a cross-sectional side view of the socket 458 and the mounting post 456 shown engaged with the socket.

Recess 460 may have a variety of possible peripheral geometric shapes. For example, in some embodiments, recess 460 may have a peripheral geometric shape comprising a generally rectangular shape. Corners of the geometric shape may be radiused. However, in further embodiments, recess 460 can have a star-shaped peripheral shape, an elliptical peripheral shape, a triangular peripheral shape, a pentagonal peripheral shape, and the like (refer to FIGS. 17-18). In some embodiments, recess 460 can even have a circular geometric shape as described above.

Recess 460 may be circularly asymmetric with reference to longitudinal axis 476. As used herein, circularly symmetric means that for a line segment extending from and orthogonal to longitudinal axis 476 and terminating at side wall 462, as the line segment is rotated about longitudinal axis 476 a length of the line segment does not vary. Accordingly, circularly asymmetric means that for a line segment extending from and orthogonal to longitudinal axis 476 and terminating at side wall 462, as the line segment is rotated about longitudinal axis 476 a length of the line segment varies. It should be noted that a circular recess 460 with a center positioned such that longitudinal axis 476 passes through the center is circularly symmetric. However, if the center of the circle is offset from longitudinal axis 476 such that recess 460 is positioned eccentrically relative to longitudinal axis 476, the recess would be circularly asymmetric.

As described above, mounting post 456 can be removably engaged with socket 458. Mounting post 456 comprises a flange 472 and a shaft 474 extending from the flange. A shape of flange 472 can be complementary to the shape of recess 460. That is, flange 472 can have the same geometric shape as recess 460 and be sized to provide a friction fit within recess 460. In other words, by way of example and not limitation, where recess 460 can comprise a generally rectangular shape, mounting post 456 may also comprise a flange 472 with a generally rectangular shape sized to provide a friction fit within recess 460 such that mounting post 456 is retained in socket 458. In addition, shaft 474 can have a geometric cross-sectional shape (e.g., outer diameter) that is about the same geometric shape and size as the interior shape of aperture 466. For example, if aperture 466 is cylindrical with a circular cross-sectional shape orthogonal to longitudinal axis 476 of aperture 466, shaft 474 can also have a circular cross-sectional shape. In accordance with some embodiments, an outside surface of shaft 474 can be smooth, without protrusions. In some embodiments, an outside cross-sectional dimension of shaft 474 may be sized to provide a friction fit with side surface 468 of aperture 466, although such friction fit may not be necessary if flange 472 provides a sufficient friction fit with recess 460, while is still other embodiments, a friction fit may be provided between both flange 472 and recess 460, and between shaft 474 and aperture 466. In some embodiments, flange 472 can have a thickness 473 in a range from about 1 mm to about 1.5 mm, for example in a range from about 1.15 to about 1.25 mm, including all arranges and subranges therebetween. In some embodiments, major surfaces 475 and 477 of flange 472 may be planar and include no protrusion.

Each mounting post 456 defines a threaded passage 478 extending along a longitudinal axis 480 of shaft 474. In some embodiments, threaded passage 478 can extend entirely through mounting post 456. However, in other embodiments, threaded passage 478 may extend through a portion of or all of shaft 474 but not flange 472. The one or more mounting posts 456 are sized to fit within through-passage 40 of optical sight 10, extending upward into through-passage 40, wherein threaded fastener 42 can be used to secure optical sight 10 to optical sight adapter 400. That is, threaded fastener 42 can be inserted into through-passage 40 and engaged with mounting post 456 via threaded passage 478, thereby securely coupling optical sight 10 to optical sight adapter 400. Mounting posts 456 provide extended engagement surfaces compared to a threaded passage extending through a thin adapter plate only. That is, mounting post 456 provides greater thread count for a threaded fastener to engage with, thereby increasing the strength of the engagement. Additionally, because mounting post 456 is configured to extend into through-passage 40 of optical sight 10, optical sight 10 is better able to withstand the shock associated with slide recoil without the optical sight shifting position. Moreover, because mounting posts 456 are removable from optical sight adapter 400 without damaging the optical sight adapter (e.g., adapter plate 402), if a mounting post is damaged (e.g., broken), the damaged mounting post can be individually replaced without discarding and replacing the entire optical sight adapter.

In various embodiments, mounting post 456 can be configured to resist rotation about longitudinal axis 480 when a torque is applied to the mounting post. For example, flange 472 can be shaped such that for a line segment extending orthogonally from longitudinal axis 480 and terminating at a periphery of flange 472, as the line segment is rotated about longitudinal axis 476, the line segment varies in length. The flange is circularly asymmetric relative to longitudinal axis 480. Moreover, when mounting post 456 is engaged in socket 458 and longitudinal axis 480 is coaxial with longitudinal axis 476, flange 472 is circularly asymmetric relative to longitudinal axis 476. This circular asymmetry ensures that if a torque is applied to mounting post 456 engaged in socket 458 with longitudinal axis 480 coaxial with longitudinal axis 476, flange 472 is unable to turn within similarly shaped recess 460, thereby preventing rotation of mounting post 456. In some embodiments, flange 472 may be circular and still meet a condition of resisting rotation if a center of the circular flange is offset from longitudinal axis 476 as previously described. Put another way, flange 472 should be configured such that the flange (e.g., a periphery thereof) is circularly asymmetric with reference to longitudinal axis 476 when the mounting post is engaged in socket 458.

To mount optical sight 10 to slide 104, mounting post 456 is inserted into socket 458 so that shaft 474 extends above first mounting surface 404 and flange 472 is fully-engaged in recess 460. For example, mounting post 456 can be inserted into socket 458 such that flange 472 is flush with second mounting surface 406. Then, optical sight adapter is secured within recessed area 118 by inserting optical sight adapter 400 into recessed area 118 so that second mounting surface 406 of optical sight adapter 400 contacts bottom surface 120 of recessed area 118. If recessed area 118 comprises an orientation feature 126, for example a raised ridge, a complementary feature on second mounting surface 406, such as recessed channel 482, can be engaged with orientation feature 126. With optical sight adapter 400 in place in recessed area 118, the optical sight adapter can be secured to slide 104 by inserting threaded fasteners 124 through apertures 454 and into engagement with threaded passages 122, after which threaded fasteners can be tightened.

Once optical sight adapter 400 is secured to slide 104, optical sight 10 can be positioned on optical sight adapter 400 so that registration pins 452 are received into recesses 44, mounting post 456 is received into through-passage 40, and threaded fastener 42 is inserted into through-passage 40 and engaged with mounting post 456 via threaded passage 478 and the threaded fastener tightened to secure optical sight 10 to optical sight adapter 400. In embodiments, optical sight adapter 400 may comprise a plurality of sockets and removable mounting posts.

It will be apparent to those skilled in the art that various modifications and variations can be made to embodiments of the present disclosure without departing from the spirit and scope of the disclosure. For example, although embodiments discussed herein were presented in the context of a handgun, the optical sight adapters disclosed can be used in conjunction with various firearms, such as but not limited to rifles (bolt-operated rifles, lever-operated rifles, gas-operated rifles and piston-operated rifles), semiautomatic handguns, and revolvers. Thus, it is intended that the present disclosure cover such modifications and variations provided they come within the scope of the appended claims and their equivalents.

What is claimed is:

1. A firearm optical sight adapter, comprising:

an adapter plate comprising a first mounting surface and a second mounting surface opposite the first mounting surface;

a registration pin integral with the mounting plate and extending orthogonally from the first mounting surface; and a socket comprising a recess extending from the second mounting surface to a bottom wall located intermediate between the first mounting surface and the second mounting surface and an aperture extending from the bottom wall of the recess through the first mounting surface along a first longitudinal axis, and wherein a periphery of the recess is circularly asymmetric relative to the first longitudinal axis.

2. The firearm optical sight adapter of claim 1, further comprising a mounting post removably engaged in the socket, the mounting post comprising a flange and a shaft extending from the flange through the first aperture, the shaft terminating beyond the first mounting surface, the mounting post further defining a threaded passage extending along a second longitudinal axis coaxial with the first longitudinal axis.

3. The firearm optical sight adapter of claim 2, wherein a shape of the flange is complementary to a shape of the recess, the recess and the flange configured to resist rotation of the mounting post about the first longitudinal axis when a torque is applied to the mounting post.

4. The firearm optical sight adapter of claim 3, wherein the adapter plate comprises a first end and a second end opposite the first end, the adapter plate further comprising a recoil buffer integral with the mounting plate and disposed at the first end of the mounting plate, the recoil buffer extending upright from the first surface.

5. The firearm optical sight adapter of claim 4, wherein the recoil buffer comprises an arcuate surface with a first curvature in a first direction.

6. The firearm optical sight adapter of claim 5, wherein the arcuate surface comprises a second curvature orthogonal to the first curvature.

7. The firearm optical sight adapter of claim 4, wherein the first end and the second end define a length of the adapter plate therebetween, and a height of the recoil buffer relative to the first mounting surface is at least 0.25 times the length of the adapter plate.

8. The firearm sight adapter of claim 7, wherein the recoil buffer defines an opening positioned between a first side member and a second side member, a cross-member extending above the opening between a top of the first side member and a top of the second side member.

9. The firearm sight adapter of claim 1, wherein the adapter plate further comprises a side edge surface between the first end and the second end, the side edge comprising a chamfer intersecting the second mounting surface.

10. A firearm optical sight adapter, comprising:

An adapter plate comprising a first mounting surface, a second mounting surface opposite the first mounting surface, a first end and a second end opposite the first end, the first end and the second end defining a length therebetween;

a registration pin integral with the adapter plate and extending orthogonally from the first mounting surface; and a recoil buffer integral with the mounting plate disposed at the first end of the mounting plate, the recoil buffer extending upright from the first mounting surface and comprising a height above the first mounting surface equal to or greater than about 0.25 times the length of the adapter plate, the recoil buffer comprising a frame defining an opening therethrough.

11. The firearm sight adapter of claim 10, further comprising a socket, the socket comprising a recess extending from the second mounting surface to a bottom wall located intermediate between the first mounting surface and the second mounting surface and an aperture extending along a first longitudinal axis from the bottom wall of the recess through the first mounting surface.

12. The firearm optical sight adapter of claim 11, wherein a periphery of the recess is circularly asymmetric relative to the first longitudinal axis.

13. The firearm optical sight adapter of claim 12, further comprising a mounting post removably engaged in the socket, the mounting post comprising a flange and a shaft extending from the flange through the second aperture, the shaft terminating beyond the first mounting surface, the mounting post further defining a threaded passage extending along a second longitudinal axis, the second longitudinal axis coaxial with the first longitudinal axis.

14. The firearm optical sight adapter of claim 13, wherein a shape of the flange is complementary to a shape of the recess, the recess and the flange configured to resist rotation of the mounting post about the longitudinal axis of the shaft when a torque is applied to the mounting post.

15. The firearm optical sight adapter of claim 10, wherein the recoil buffer comprises an arcuate surface facing in a direction toward the second end, the arcuate surface comprising a first curvature in a first direction.

16. The firearm optical sight adapter of claim 15, wherein the arcuate surface comprises a second curvature orthogonal to the first curvature.

17. The firearm optical sight adapter of claim 10, wherein the opening comprises an upwardly convex curvature that defines a top of the opening.

18. A firearm optical sight adapter, comprising:

an adapter plate comprising a first mounting surface, a second mounting surface opposite the first mounting surface, a first end and a second end opposite the first end, the first end and the second end defining a length therebetween;

a registration pin integral with the adapter plate and extending orthogonally from the first mounting surface; and a recoil buffer integral with the mounting plate disposed at the first end of the mounting plate, the recoil buffer extending upright from the first mounting surface a distance of at least 0.25 times the length of the adapter plate and comprising a D-shaped opening therein.

19. The firearm sight adapter of claim 18, further comprising a socket, the socket comprising a recess extending from the second mounting surface to a bottom wall located intermediate between the first mounting surface and the second mounting surface and an aperture extending along a first longitudinal axis from the bottom wall of the recess through the first mounting surface.

20. The firearm optical sight adapter of claim 19, wherein a periphery of the recess is circularly asymmetric relative to the first longitudinal axis.

21. The firearm optical sight adapter of claim 20, further comprising a mounting post removably engaged in the socket, the mounting post comprising a flange and a shaft extending from the flange through the second aperture, the shaft terminating beyond the first mounting surface, the mounting post further defining a threaded passage extending along a second longitudinal axis, the second longitudinal axis coaxial with the first longitudinal axis.

22. The firearm optical sight adapter of claim 21, wherein a shape of the flange is complementary to a shape of the recess, the recess and the flange configured to resist rotation of the mounting post about the first longitudinal axis when a torque is applied to the mounting post.

* * * * *